US011171404B2

(12) United States Patent
Takeuchi et al.

(10) Patent No.: US 11,171,404 B2
(45) Date of Patent: Nov. 9, 2021

(54) ANTENNA AND WINDOW GLASS FOR VEHICLE

(71) Applicant: AGC Inc., Tokyo (JP)

(72) Inventors: Shoichi Takeuchi, Tokyo (JP); Naoki Hashimoto, Tokyo (JP); Hideaki Shoji, Tokyo (JP)

(73) Assignee: AGC INC., Tokyo (JP)

( * ) Notice: Subject to any disclaimer, the term of this patent is extended or adjusted under 35 U.S.C. 154(b) by 21 days.

(21) Appl. No.: 16/857,543

(22) Filed: Apr. 24, 2020

(65) Prior Publication Data

US 2020/0251804 A1 Aug. 6, 2020

Related U.S. Application Data

(63) Continuation of application No. PCT/JP2018/041009, filed on Nov. 5, 2018.

(30) Foreign Application Priority Data

Nov. 7, 2017 (JP) ..... JP2017-214363

(51) Int. Cl.
*H01Q 1/12* (2006.01)
*H01Q 13/10* (2006.01)

(52) U.S. Cl.
CPC ..... *H01Q 1/1278* (2013.01); *H01Q 13/10* (2013.01)

(58) Field of Classification Search
CPC .... H01Q 13/10; H01Q 1/1271; H01Q 1/1278; H01Q 1/32; H01Q 5/10
See application file for complete search history.

(56) References Cited

U.S. PATENT DOCUMENTS

2003/0164800 A1* 9/2003 Jordan ..... H01Q 1/1271 343/713
2005/0168389 A1* 8/2005 Yuanzhu ..... H01Q 13/10 343/767

(Continued)

FOREIGN PATENT DOCUMENTS

JP 2010-114688 A 5/2010
WO WO-2017/018324 A1 2/2017

OTHER PUBLICATIONS

International Searching Authority, "International Search Report," issued in connection with International Patent Application No. PCT/JP2018/041009, dated Jan. 15, 2019.

(Continued)

*Primary Examiner* — Jason Crawford
(74) *Attorney, Agent, or Firm* — Foley & Lardner LLP

(57) ABSTRACT

An antenna includes a flat conductor, and the flat conductor includes a first slot extending in a first direction, a second slot connected to the first slot and extending in a second direction, a third slot connected to the first slot and including another end that is open through an outer edge of the conductor, the third slot extending to one side of the first slot opposite from the second slot, and a fourth slot connected to the second slot, the fourth slot extending to one side of the second slot opposite from the first slot, wherein the third slot has a wide portion, and the fourth slot has a wide portion, and the outer edge includes an inclined portion inclined with respect to a virtual line that passes through the another end of the third slot and that is perpendicular to a direction in which the third slot extends.

12 Claims, 16 Drawing Sheets

(56) References Cited

U.S. PATENT DOCUMENTS

| | | | | |
|---|---|---|---|---|
| 2006/0152421 | A1* | 7/2006 | Baranski | B32B 17/10036 343/713 |
| 2015/0357700 | A1* | 12/2015 | Kagaya | H01Q 1/1285 343/713 |
| 2018/0138586 | A1* | 5/2018 | Takeuchi | H01Q 5/364 |
| 2018/0151939 | A1* | 5/2018 | Hashimoto | H01Q 1/1278 |

OTHER PUBLICATIONS

International Searching Authority, "Written Opinion," issued in connection with International Patent Application No. PCT/JP2018/041009, dated Jan. 15, 2019.

* cited by examiner

ANTENNA AND WINDOW GLASS FOR VEHICLE

CROSS-REFERENCE TO RELATED APPLICATION

The present application is a continuation application filed under 35 U.S.C. 111 (a) claiming benefit under 35 U.S.C. 120 and 365 (c) of PCT International Application No. PCT/JP2018/041009 filed on Nov. 5, 2018 and designating the U.S., which claims priority to Japanese Patent Application No. 2017-214363 filed on Nov. 7, 2017. The entire contents of the foregoing applications are incorporated herein by reference.

BACKGROUND OF THE INVENTION

1. Field of the Invention

The present invention relates to an antenna and a window glass for a vehicle.

2. Description of the Related Art

A high-speed communication system such as a telematics service, in which information is transmitted and received between a communication device on a vehicle and a device at the outside of the vehicle, uses an antenna that can attain impedance matching over a relatively wide frequency range. As an antenna supporting such a wide band, an antenna famed with a conductive film is known (for example, see PTL 1).

PRIOR ART DOCUMENT

Patent Literature

PTL 1: International Publication No. 2017/018324

SUMMARY OF THE INVENTION

Technical Problem

However, an antenna formed with a flat conductor such as a conductive film is desired to not only support a wide frequency range but also further improve an antenna gain.

Accordingly, in the present disclosure, an antenna supporting a wide frequency range and improving an antenna gain and a window glass for a vehicle provided with the antenna are provided.

Solution to Problem

According to an aspect of the present invention, provided is an antenna including a flat conductor, the flat conductor including a first feeding point and a second feeding point located away from each other, a first slot extending in a first direction between the first feeding point and the second feeding point, a second slot including one end connected to one end of the first slot, the second slot extending in a second direction different from the first direction, a third slot including one end connected to another end of the first slot and another end that is open through an outer edge of the conductor, the third slot extending to one side of the first slot opposite from the second slot, and a fourth slot including one end connected to another end of the second slot, the fourth slot extending to one side of the second slot opposite from the first slot, wherein the third slot has a portion of which slot width is wider than the first slot, the fourth slot has a portion of which slot width is wider than the second slot, and the outer edge includes an inclined portion inclined with respect to a virtual line that passes through the another end of the third slot and that is perpendicular to a direction in which the third slot extends.

Effect of Invention

According to an aspect of the present disclosure, an antenna supporting a wide frequency range with an improved antenna gain and a window glass for a vehicle provided with the antenna can be provided.

DETAILED DESCRIPTION OF THE PREFERRED EMBODIMENTS

Hereinafter, an embodiment for carrying out the present invention will be described with reference to the drawings. In each embodiment, deviations from directions such as parallel direction, perpendicular direction, orthogonal direction, horizontal direction, vertical direction, height direction, widthwise direction and the like are tolerated to such an extent that the effects of the present invention are not impaired. Further, the shape at a corner portion of an antenna element is not limited to a right angle, and may be rounded in a shape of a bow. Each top view illustrates a glass plate (hereinafter also referred to as "window glass") for a window of a vehicle as seen from a vehicle-inner side (a viewpoint from the inside of the vehicle) by facing a glass surface of the glass plate, when the window glass is attached to the vehicle. In a case where the window glass is a windshield attached to a front portion of the vehicle or rear glass attached to a rear portion of the vehicle, a height direction in each top view corresponds to a height direction of the vehicle, and a widthwise direction in each top view corresponds to a widthwise direction of the vehicle. Further, the window glass is not limited to a windshield or a rear glass, and may be, for example, a side glass attached to a side portion of the vehicle. In each top view, the direction parallel to an X axis (X axis direction), the direction parallel to a Y axis (Y axis direction), and the direction parallel to a Z axis (Z axis direction) represent a widthwise direction of the glass plate, a height direction of the glass plate, and a direction perpendicular to the face of the glass plate (also referred to as a normal direction), respectively. The X axis direction, the Y axis direction, and the Z axis direction are orthogonal to each other.

Figure 1:
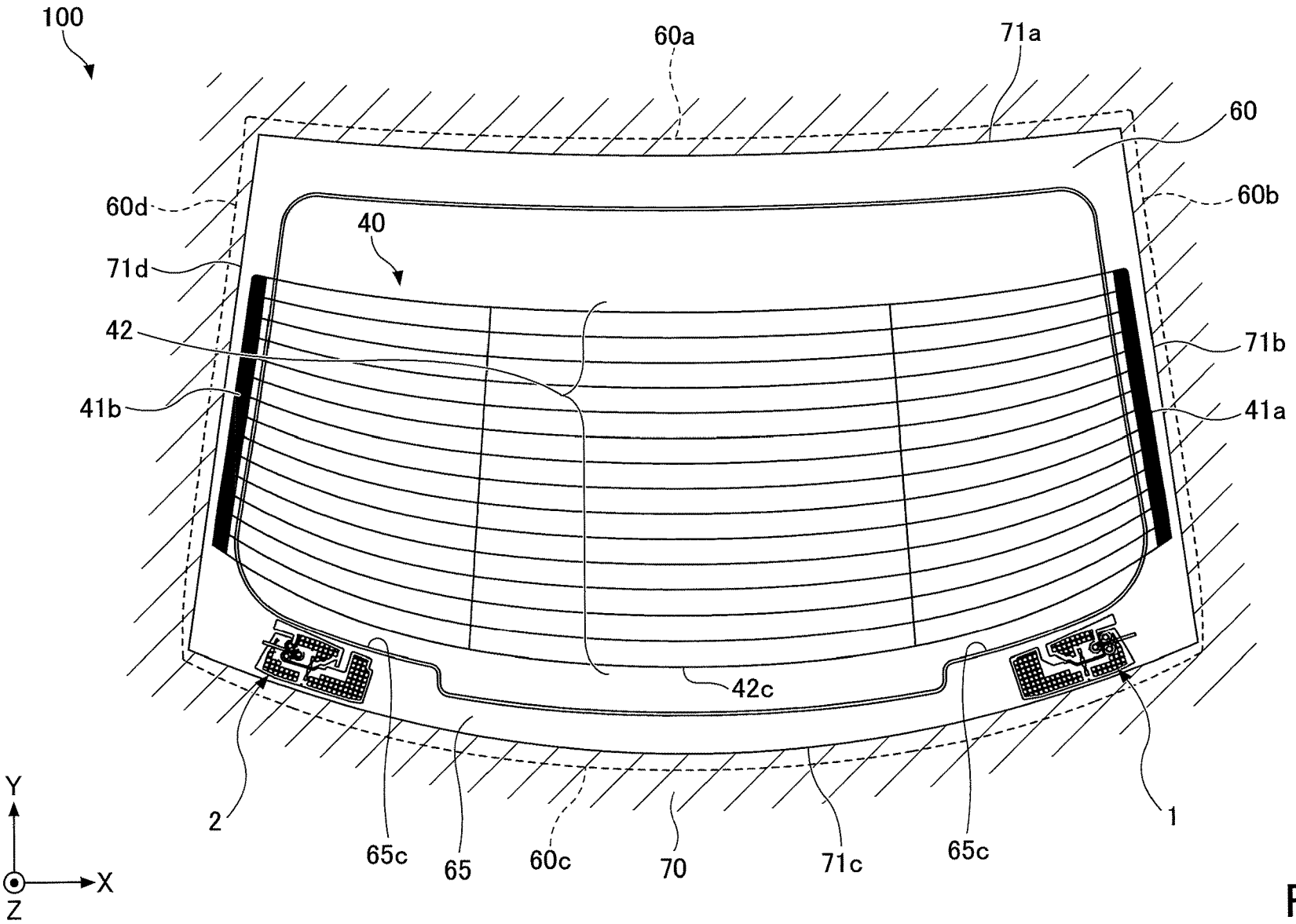
FIG. 1 is a plan view illustrating an example of a configuration of a window glass for a vehicle from a viewpoint at a vehicle-inner side.

FIG. 1 is a plan view illustrating an example of a configuration of a window glass for a vehicle from a viewpoint at a vehicle-inner side. The window glass 100 for the vehicle as illustrated in FIG. 1 is an example of a rear glass attached to the rear portion of a vehicle. The window glass 100 for a vehicle includes a glass plate 60 for a window of a vehicle, a defogger 40 disposed in the glass plate 60, a right rear antenna 1 disposed in a right-hand lower side area of the glass plate 60, and a left rear antenna 2 disposed in a left-hand lower side area of the glass plate 60. In addition, an antenna (not illustrated), which is at least one of AM radio, FM radio, DAB (Digital Audio Broadcast), television broadcast, and remote keyless entry antennas, may be provided between the defogger 40 and an upper edge 60*a* of the glass plate 60.

The glass plate 60 is an example of a glass plate for a window of a vehicle. An outer shape of the glass plate 60 is substantially in a quadrilateral shape. The upper edge 60*a* represents a glass edge at an upper side of the glass plate 60. A lower edge 60*c* represents a glass edge at a lower side of the glass plate 60 (i.e., a side opposite to the upper edge 60*a*). A right edge 60*b* represents a glass edge at a right-hand side of the glass plate 60. A left edge 60*d* represents a glass edge at a left-hand side of the glass plate 60 (i.e., a side opposite to the right edge 60*b*). The right edge 60*b* is a glass edge adjacent to the right-hand side portions of the upper edge 60*a* and the lower edge 60*c*. The left edge 60*d* is a glass edge adjacent to left-hand side portions of the upper edge 60*a* and the lower edge 60*c*.

The glass plate 60 has a pair of side edges. The right edge 60*b* is an example of a first side edge which is one of the pair of side edges. The left edge 60*d* is an example of a second side edge which is the other of the pair of side edges. Although a connection portion between the upper edge 60*a* and the right edge 60*b* is connected with a curvature, the connection portion may be connected without a curvature. This is also applicable to the shapes of the connection portions between other edges.

The defogger 40 is an electrical heating type conductor pattern that defogs the glass plate 60. The defogger 40 includes a plurality of heating wires extending in the widthwise direction of the glass plate 60 and a plurality of bus bars that feed power to the plurality of heating wires. In the present embodiment, a plurality of heating wires 42 extending in the widthwise direction of the glass plate 60 so as to run in parallel to each other, and a pair of bus bars 41*a*, 41*b* connected to the plurality of heating wires 42 are provided on the glass plate 60. When a voltage is applied between the pair of bus bars 41*a*, 41*b*, the plurality of heating wires 42 are energized to generate heat, which defogs the glass plate 60.

The plurality of heating wires 42 are conductive patterns connected between the right bus bar 41*a* and the left bus bar 42*b*. The right bus bar 41*a* is an example of a first bus bar, and is a conductive pattern extending in the height direction of the glass plate 60 along the right edge 60*b*. The left bus bar 41*b* is an example of a second bus bar, and is a conductive pattern extending in the height direction of the glass plate 60 along the left edge 60*d*.

The window glass 100 for the vehicle is attached to a window frame 70 formed through a metal body of the vehicle. The window frame 70 includes frame edges (an upper frame edge 71*a*, a right frame edge 71*b*, a lower frame edge 71*c*, and a left frame edge 71*d*) for forming the window.

The right rear antenna 1 and the left rear antenna 2 are provided in a margin area at the lower side of the defogger 40. In the present embodiment, the right rear antenna 1 and the left rear antenna 2 are provided in a margin area between lowermost heating wires 42*c* of the plurality of heating wires 42 and the lower edge 60*c* of the glass plate 60. When the window glass 100 for the vehicle is attached to the window frame 70, the right rear antenna 1 and the left rear antenna 2 are located in proximity to the lower frame edge 71*c* of the window frame 70. In the present embodiment, the right rear antenna 1 and the left rear antenna 2 are located between the lower frame edge 71*c* and the lowermost heating wires 42*c*.

Further, at least some of the functional units such as a bus bar, a heating wire, a feeding portion, and the antennas 1, 2 may be arranged on a light shielding film 65 famed in a peripheral area of the glass plate 60. A specific example of the light shielding film 65 includes ceramics such as a black ceramic film. When the window glass 100 for the vehicle is viewed from the outside of the vehicle, the portion overlapping the light shielding film 65 is not visible from the outside of the vehicle. This improves the design of the window glass 100 for the vehicle and improves the design of the vehicle.

In the present embodiment, the right rear antenna 1 and the left rear antenna 2 are arranged in a belt-like light shielding area between a light shielding film edge 65*c* at a lower side of the light shielding film 65 and the lower edge 60*c* of the glass plate 60. Upper edges of the right rear antenna 1 and the left rear antenna 2 are formed along the light shielding film edge 65*c* so that at least a part of the right rear antenna 1 and the left rear antenna 2 is not exposed from the light shielding film 65. Therefore, the design of the window glass 100 for the vehicle and the design of the vehicle are improved.

Figure 2:
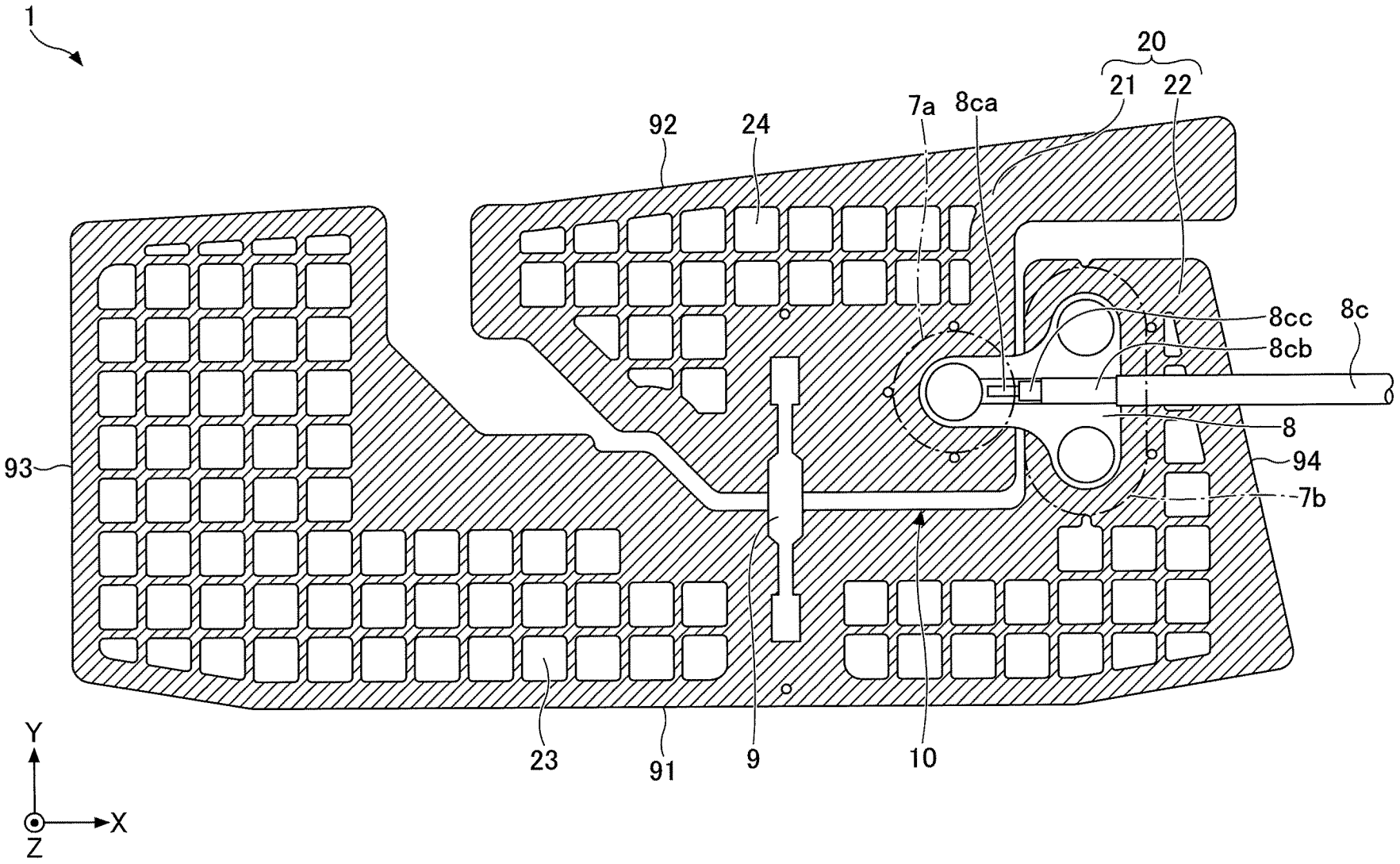
FIG. 2 is a drawing illustrating an example of a state in which a coaxial cable is connected to a pair of feeding points in an antenna according to a first embodiment.

FIG. 2 is a drawing illustrating an example of a state in which a coaxial cable is connected to a pair of feeding points in the antenna according to the first embodiment. FIG. 2 illustrates a state in which one end of a coaxial cable 8*c* is indirectly connected by a connector 8 to a core-side feeding point 7*a* and a ground-side feeding point 7*b* of the antenna 1. The core-side feeding point 7*a* is an example of a first feeding point. The ground-side feeding point 7*b* is an example of a second feeding point. The feeding portion includes a pair of feeding points. The other end of the coaxial cable 8*c* is connected to, for example, a device having at least one of a transmission function and a reception function. The core-side feeding point 7*a* is connected to a center conductor (core wire 8*ca*) of the coaxial cable 8*c* via the connector 8 by solder and the like. The ground-side feeding point 7*b* is connected to an outer conductor 8*cb* of the coaxial cable 8*c* via the connector 8 by solder and the like. The core wire 8*ca* and the outer conductor 8*cb* are insulated by an insulator 8*cc*. It should be noted that the pair of feeding points may be directly connected to one end of a coaxial cable.

The antenna 1 is a slot antenna formed with a conductive film 20. The antenna 1 functions as a slot antenna with a slot 10 (elongated cutout) formed in the conductive film 20.

The conductive film 20 is an example of a film-shaped or plate-shaped flat conductor, and is a substantially rectangular film having conductivity. In the first embodiment, the conductive film 20 includes a lower-side outer edge 91 and an upper-side outer edge 92, which are opposite to each other in the Y axis direction, and includes a left-side outer edge 93 and a right-side outer edge 94, which are opposite to each other in the X axis direction perpendicular to the Y axis direction.

Here, four outer edges of the conductive film 20 are denoted as outer edges A, B, C, and D. An aspect in which the outer edge A and the outer edge B are opposite to each other in a first direction includes not only a case where each of the outer edge A and the outer edge B is perpendicular to the first direction, but also a case where at least one of the outer edge A and the outer edge B is inclined with respect to the first direction. An aspect in which the outer edge C and the outer edge D are opposite to each other in a second direction includes not only a case where each of the outer edge C and the outer edge D is perpendicular to the second direction, but also a case where at least one of the outer edge C and the outer edge D is inclined with respect to the second direction. The above features are also applicable to other embodiments.

In the first embodiment, the Y axis direction is an example of the first direction, and the X axis direction is an example of the second direction different from the first direction. The right-side outer edge 94 is an example of one outer edge. The upper-side outer edge 92 is an example of another outer edge. The lower-side outer edge 91 is an example of a third outer edge. The left-side outer edge 93 is an example of a fourth outer edge.

The conductive film 20 includes a core-side conductor 21 extending to one side of the slot 10 and a ground-side conductor 22 extending to another side of the slot 10. The core-side conductor 21 includes a core-side feeding point 7*a*. The ground-side conductor 22 includes a ground-side feeding point 7*b*. In the present embodiment, the core-side conductor 21 and the ground-side conductor 22 are separated by the slot 10. While the window glass 100 for the vehicle is attached to the window frame 70, the ground-side conductor 22 comes into proximity with the lower frame edge 71*c* of the window frame 70, and the core-side conductor 21 is located farther from the lower frame edge 71*c* than the ground-side conductor 22.

At least one of the core-side conductor 21 and the ground-side conductor 22 may have a perforated portion (a hole-formed portion) in which holes are formed in the conductive film 20. In an aspect in which the conductive film 20 is formed on the glass plate 60 by printing, embedding, pasting, and the like, when a metal area of the conductive film 20 is too large, the formability of glass may be reduced due to a difference in heat absorption between glass and metal. By forming the hole-formed portion, the area of the conductive film 20 can be increased while ensuring the formability of the glass. As the area of the conductive film 20 increases, the degree of flexibility in designing a slot antenna improves.

In the present embodiment, in an area where the core-side feeding point 7*a*, the ground-side feeding point 7*b*, and the resistor 9 are not formed, the core-side conductor 21 is formed with a lattice-shaped hole-formed portion 24, and the ground-side conductor 22 is famed with a lattice-shaped hole-formed portion 23. The shape of each hole of the hole-formed portion is not limited to a quadrilateral shape, but may be a polygonal shape other than the quadrilateral shape (for example, triangular and hexagonal shapes), circular, and other shapes.

A resistor 9 for wire-breaking detection may be provided in the conductive film 20. The resistor 9 is arranged to extend over the slot 10, such that one end of the resistor 9 is connected to the core-side conductor 21, and the other end of the resistor 9 is connected to the ground-side conductor 22. As a result, a closed circuit is formed through the core wire 8*ca* of the coaxial cable 8*c*, the core-side conductor 21, the resistor 9, the ground-side conductor 22, and the outer conductor 8*cb* of the coaxial cable 8*c*. With the resistor 9, a device connected to the other end of the coaxial cable 8*c* can determine that the antenna 1 is not connected to the coaxial cable 8*c* in a case where a resistance value in a predetermined range is not detected from the closed circuit including the resistor 9. Such a device may also determine breaking of the glass plate 60 by detecting a change in the resistance value.

Figure 3:
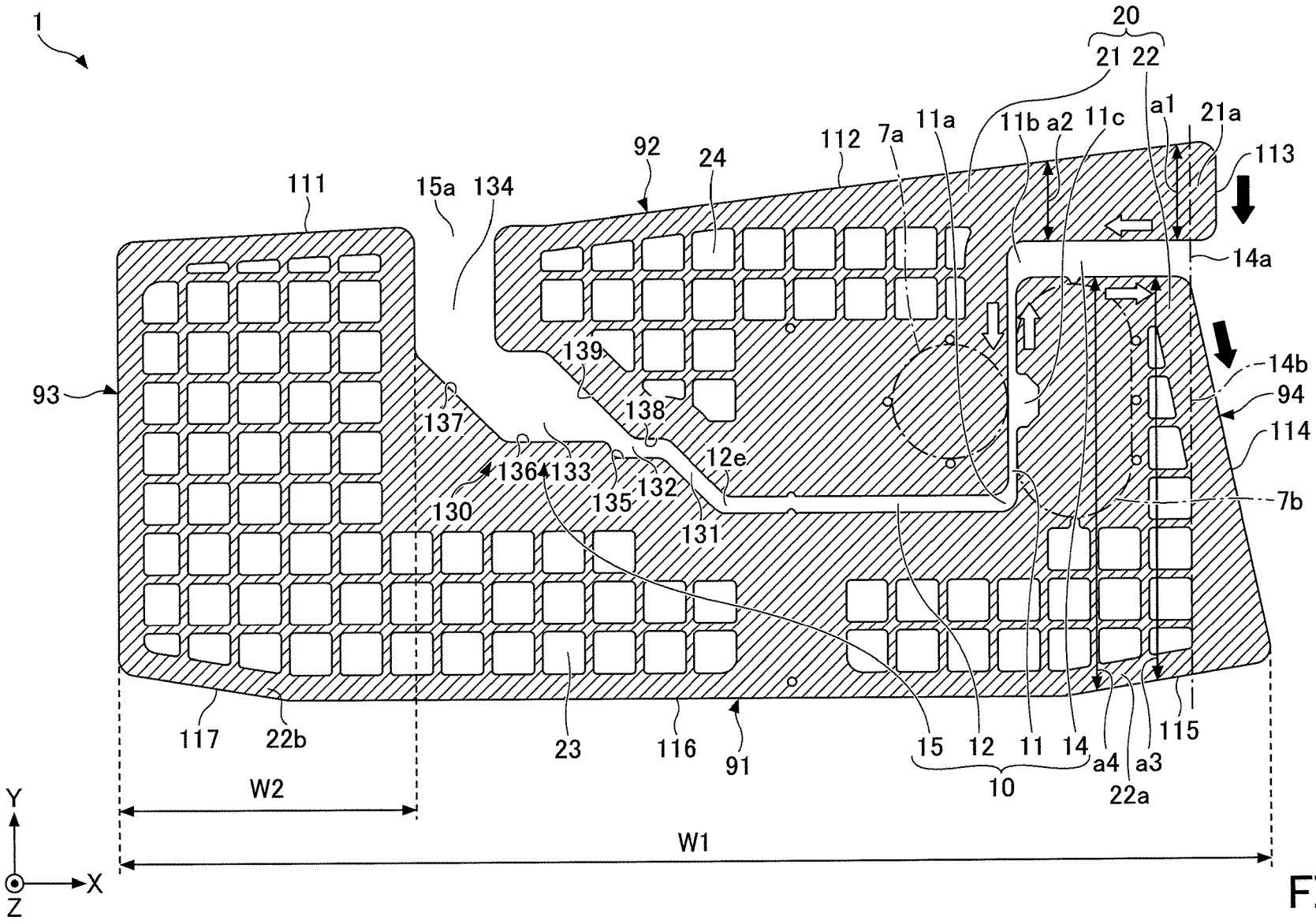
FIG. 3 is a plan view illustrating a configuration example of the antenna according to the first embodiment.

FIG. 3 is a plan view illustrating a configuration example of the antenna according to the first embodiment. FIG. 3 illustrates a state in which the connector 8 (see FIG. 2) connected to one end of the coaxial cable 8*c* is detached from the conductive film 20 with which the antenna 1 is formed.

The conductive film 20 with which the antenna 1 is formed includes: the lower-side outer edge 91 and the upper-side outer edge 92, which are opposite to each other in the Y axis direction; the left-side outer edge 93 and the right-side outer edge 94, which are opposite to each other in the X axis direction; and a feeding portion including the core-side feeding point 7*a* and the ground-side feeding point 7*b*, which are opposite to each other in the X axis direction. In FIG. 3, the lower-side outer edge 91 includes a lower edge right portion 115, a lower edge intermediate portion 116, and a lower edge left portion 117. The upper-side outer edge 92 includes an upper edge left portion 111 and an upper edge right portion 112. The right-side outer edge 94 includes a right edge upper portion 113 and a right edge lower portion 114.

The conductive film 20 includes the slot 10. The slot 10 includes a vertical slot 11, a horizontal slot 12, a right wide slot 14, and a left wide slot 15. The right wide slot 14, the vertical slot 11, the horizontal slot 12, and the left wide slot 15 are connected consecutively in this order.

The vertical slot 11 is an example of a first slot. The vertical slot 11 extends in the Y axis direction between the core-side feeding point 7*a* and the ground-side feeding point 7*b*. The vertical slot 11 includes, in the Y axis direction, one end located at the same side as the lower-side outer edge 91 and another end located at the same side as the upper-side outer edge 92.

The horizontal slot 12 is an example of a second slot. The horizontal slot 12 includes one end connected at a connection point 11*a* with the one end of the vertical slot 11 located at the same side as the lower-side outer edge 91. The horizontal slot 12 extends in the X axis direction at the same side as the left-side outer edge 93 with respect to the vertical slot 11.

The right wide slot 14 is an example of a third slot. The right wide slot 14 includes one end connected at a connection point 11*b* with the another end of the vertical slot 11 located at the same side as the upper-side outer edge 92 and another end (open end 14*a*) that is open through the right-side outer edge 94. The connection point 11*b* is located at a side opposite the connection point 11*a* with respect to a portion where the vertical slot 11 is sandwiched between the core-side feeding point 7*a* and the ground-side feeding point 7*b*. The right wide slot 14 extends at one side of the vertical slot 11 opposite from the horizontal slot 12. Specifically, the right wide slot 14 extends in the X axis direction at the same side as the right-side outer edge 94 with respect to the vertical slot 11. The right wide slot 14 has a portion of which slot width is wider than the vertical slot 11.

The left wide slot 15 is an example of a fourth slot. The left wide slot 15 has one end connected at a connection point 12*e* with another end of the horizontal slot 12 at the same side as the left-side outer edge 93. The left wide slot 15 extends at one side of the horizontal slot 12 opposite from the vertical slot 11. In other words, the horizontal slot 12 is located between the vertical slot 11 and the left wide slot 15. The left wide slot 15 extends at the same side as the upper-side outer edge 92 with respect to a virtual extension line extending in a direction in which the horizontal slot 12 extends. The left wide slot 15 has a portion of which slot width is wider than the horizontal slot 12.

Here, in a case where the vehicle body is made of metal, if a radiating element of a silver paste antenna in a line shape is placed near the vehicle body on window glass, the reception gain of the antenna will decrease due to interference with the metal.

However, because the antenna according to the present embodiment is a slot antenna, the electric field generated by a current flowing through the conductive film 20 is formed in a closed manner inside the conductive film 20 and is less susceptible to interference with metal or resin.

Therefore, even when a metal such as a defogger and a vehicle body or a resin portion of the vehicle body is in proximity to a peripheral area of the antenna according to the present embodiment, stable characteristics can be obtained. Furthermore, even if a metal film such as a transparent conductive film is famed in the peripheral portion, characteristics that are less susceptible to interference can be obtained.

The frequencies of communication waves differ from country to country, and carriers use different frequency bands within a country. Therefore, an antenna corresponding to a wide frequency range is preferable so as to be able to transmit and receive a plurality of communication waves.

In a UHF (Ultra High Frequency) wave used for communication, the antenna according to the present embodiment is configured to be able to communicate, for example, in three of the bands (0.698 GHz to 0.96 GHz (low band), 1.71 GHz to 2.17 GHz (medium band), and 2.5 GHz to 2.69 GHz (high band)) used for LTE (Long Term Evolution).

Furthermore, the antenna according to the present embodiment is also suitable for transmission and reception of electromagnetic waves in the ISM (Industry Science Medical) band. The ISM band includes 0.863 GHz to 0.870 GHz (Europe), 0.902 GHz to 0.928 GHz (USA), and 2.4 GHz to 2.5 GHz (used all over the world). Examples of communication standards using the 2.4 GHz band, which is one of the ISM bands, include wireless LAN (Local Area Network) using DSSS (Direct Sequence Spread Spectrum) compliant with IEEE802.11b, Bluetooth (registered trademark), and some of the FWA (Fixed Wireless Access) system. The electromagnetic waves transmitted and received by the antenna according to the present embodiment are not limited to these frequency bands, and can also be applied to frequency bands up to 6 GHz in the fifth generation communication (5G) standard.

In the antenna 1 according to the first embodiment, the vertical slot 11, the horizontal slot 12, the right wide slot 14, and the left wide slot 15 are famed with the conductive film 20. Therefore, the antenna 1 can support a plurality of wide frequency bands. The antenna 1 having the shape illustrated in FIG. 3 is suitable for transmitting and receiving electromagnetic waves in wide frequency bands used for LTE.

Furthermore, in field tests of communication services in recent years, vertical polarization tends to be regarded as important in low frequency bands. In the antenna 1 according to the first embodiment, the horizontal slot 12, the right wide slot 14, and the left wide slot 15 have a slot component that extends in a substantially horizontal direction when the antenna 1 is attached to the vehicle. Therefore, the antenna 1 is suitable for transmitting and receiving vertically polarized electromagnetic waves.

Therefore, since the antenna according to the present embodiment is provided on the glass plate, the antenna has less impact on the design and aerodynamic characteristics of the vehicle, and since the antenna is provided on an outer peripheral area of the glass plate, the antenna has less impact on the appearance, and furthermore, the antenna can support transmission and reception of electromagnetic waves in wide frequency ranges.

It should be noted that when the antenna 1 is attached so that the horizontal slot 12, the right wide slot 14, and the left wide slot 15 have a slot component that extends in a substantially vertical direction when the antenna 1 is attached to the vehicle, the antenna 1 is suitable for transmitting and receiving horizontally polarized electromagnetic waves.

In FIG. 3, the right-side outer edge 94 has an inclined portion which is inclined with respect to a virtual line 14*b* passing through the open end 14*a* and perpendicular to the direction in which the right wide slot 14 extends, and which extends at one side of the virtual line 14*b* opposite from the right wide slot 14. In the present embodiment, the right-side outer edge 94 includes a right edge lower portion 114 which is an inclined portion extending at the same side as the vertical slot 11 with respect to a virtual extension line extending in a direction in which the right wide slot 14 extends.

The right edge lower portion 114 is an outer edge portion of the right-side outer edge 94 at the same side as the lower-side outer edge 91 with respect to the open end 14*a*. The right edge lower portion 114 extends at one side of the virtual line 14*b* opposite from the right wide slot 14 in such a manner that a portion of the conductive film 20 expands. The right edge lower portion 114 is inclined with respect to a virtual extension line extending in a direction in which the right wide slot 14 extends, and extends in such a manner that the portion of the conductive film 20 protrudes from the virtual line 14*b*. For example, the right edge lower portion 114 is inclined with respect to the virtual line 14*b* in such a manner that a maximum external dimension W1 of the conductive film 20 in the X axis direction increases.

The right wide slot 14 and the vertical slot 11 form a notch antenna in which a slot is bent into a right angle at one portion (connection point 11*b*). Since the currents flowing along both sides of the right wide slot 14 flow in opposite phases and close to each other, a magnetic flux generated by the current flowing along one side and a magnetic flux generated by the current flowing along the other side are generated in directions to cancel each other. Likewise, since the currents flowing along both sides of the vertical slot 11 flow in opposite phases and close to each other, a magnetic flux generated by the current flowing along one side and a magnetic flux generated by the current flowing along the other side are generated in directions to cancel each other. Therefore, these currents represented by white arrows in FIG. 3 do not appreciably contribute to the radiation of the antenna 1.

Conversely, as for the currents flowing along the right-side outer edge 94, a current flowing along the right edge upper portion 113 and a current flowing along the right edge lower portion 114 flow in substantially the same phase, and the magnetic fluxes generated by these currents are not in directions to cancel each other. Therefore, these currents represented by black arrows in FIG. 3 contribute to the radiation of the antenna 1. Since a relatively large conductor area exists between the right edge upper portion 113 and the virtual line 14*b*, the flow of the current along the right edge lower portion 114 is less likely to be restricted.

As described above, the right-side outer edge 94 includes a right edge lower portion 114 inclined with respect to the virtual line 14*b* as an inclined portion that extends at one side of the virtual line 14*b* opposite from the right wide slot 14. Since an inclined portion such as the right edge lower portion 114 extends, a current excited along the right-side outer edge 94 (i.e., a current contributing to radiation of the antenna 1) increases. As a result, the antenna gain of the antenna 1 increases. In the antenna 1, not only the slot 10 but also an inclined portion such as the right edge lower portion 114 achieves an effect (i.e., the antenna 1 does not operate in a single frequency), so that the antenna 1 functions as a slot antenna operating at frequencies in wide frequency ranges.

In the present embodiment, the right edge lower portion 114 extends from the open end 14*a*. Alternatively, the right edge lower portion 114 may be configured to extend to an intermediate point along the virtual line 14*b* from the open end 14*a*, and the right edge lower portion 114 may be inclined from the intermediate point with respect to the virtual line 14*b*.

The inclined portion that is inclined with respect to the virtual line 14*b* and that extends at one side of the virtual line 14*b* opposite from the right wide slot 14 may be the right edge upper portion 113. When the right edge upper portion 113 is inclined in this manner, the antenna gain of the antenna 1 improves. As for the aspect in which the right edge upper portion 113 is inclined, the above explanation about the right edge lower portion 114 is incorporated herein by reference. The inclined portion that is inclined with respect to the virtual line 14*b* and that extends at one side of the virtual line 14*b* opposite from the right wide slot 14 may include both of the right edge upper portion 113 and the right edge lower portion 114. Even in an aspect in which the right-side outer edge 94 has an inclined portion that is inclined with respect to the virtual line 14*b* and that extends at the same side as the right wide slot 14 with respect to the virtual line 14*b*, the antenna gain of the antenna 1 improves, and the antenna 1 functions as a slot antenna operating at frequencies in wide frequency ranges.

In FIG. 3, the conductive film 20 may have a recessed portion 11*c* partially expanding a slot width of the vertical slot 11. The recessed portion 11*c* is a portion of the vertical slot 11 where the ground-side conductor 22 is recessed. When the recessed portion 11*c* is provided, the capacitive coupling between the core wire 8*ca* of the coaxial cable 8*c* and the ground-side feeding point 7*b* decreases, and accordingly, the return loss characteristics and the antenna gain of the antenna 1 improves. The recessed portion 11*c* can suppress fluctuations in the characteristic of the antenna 1, even when the position where the connector 8 is mounted on the feeding portion is slightly shifted. The recessed portion 11*c* allows the mounting surface of the connector 8 to be easily bonded to the recessed portion 11*c* with an adhesive member such as double-sided tape, and accordingly, the ease of installation of the connector 8 improves.

In FIG. 3, the conductive film 20 includes, for example, another outer edge that extends at one side of the virtual extension line, extending in the direction in which the right wide slot 14 extends, opposite from the vertical slot 11. The upper-side outer edge 92 is an example of the another outer edge. The upper-side outer edge 92 includes a second inclined portion that is inclined with respect to the virtual extension line extending in the direction in which the right wide slot 14 extends. The upper edge right portion 112 is an example of the second inclined portion. A distance a1 between the upper edge right portion 112 and the right wide slot 14 at the another end (the open end 14*a*) of the right wide slot 14 is longer than a distance a2 between the upper edge right portion 112 and the right wide slot 14 at the one end (the connection point 11*b*) of the right wide slot 14. In the present embodiment, the distance in the Y axis direction between the upper edge right portion 112 and the right wide slot 14 increases away from the connection point 11*b* toward the open end 14*a*. In other words, the conductor area width, in the Y axis direction, of the conductor area 21*a*, which is present between the upper edge right portion 112 and the right wide slot 14, increases away from the connection point 11*b* toward the open end 14*a*. In FIG. 3, the shortest distance in the Y axis direction between the upper edge right portion 112 and the open end 14*a* is longer than the shortest distance in the Y axis direction between the upper edge right portion 112 and the connection point 11*b*.

In this manner, the upper-side outer edge 92 includes the upper edge right portion 112 as an example of the second inclined portion. Because of the existence of the second inclined portion such as the upper edge right portion 112, the size of the conductive film 20 in the Y axis direction can be reduced (in particular, the size in the Y axis direction can be reduced in a central area of the conductive film 20 in the X axis direction). The upper edge right portion 112 is formed along the light shielding film edge 65*c* (see FIG. 1) so that a part of the conductive film 20 is not exposed from the light shielding film 65. As a result, the design of the window glass 100 for the vehicle and the design of the vehicle improve.

In FIG. 3, the conductive film 20 includes, for example, a third outer edge that extends at one side of the virtual extension line, extending in the direction in which the horizontal slot 12 extends, opposite from the vertical slot 11. The lower-side outer edge 91 is an example of a third outer edge. The lower-side outer edge 91 includes a third inclined portion inclined with respect to the virtual extension line extending in a direction in which the right wide slot 14 extends. The lower edge right portion 115 is an example of the third inclined portion. A distance a3 between the lower edge right portion 115 and the right wide slot 14 at the another end (the open end 14*a*) of the right wide slot 14 is shorter than a distance a4 between the lower edge right portion 115 and the right wide slot 14 at the one end (the connection point 11*b*) of the right wide slot 14. In the present embodiment, a distance in the Y axis direction between the lower edge right portion 115 and the right wide slot 14 decreases away from the connection point 11*b* toward the open end 14*a*. In other words, the conductor area width, in the Y axis direction, of the conductor area 22*a*, which is present between the lower edge right portion 115 and the right wide slot 14, decreases away from the connection point 11*b* toward the open end 14*a*.

In this manner, the lower-side outer edge 91 includes the lower edge right portion 115 as an example of the third inclined portion. Because of the extension of the third inclined portion such as the lower edge right portion 115, the size of the conductive film 20 in the Y axis direction can be reduced (in particular, the size in the Y axis direction can be reduced in a right end area of the conductive film 20 in the X axis direction). The lower edge right portion 115 is formed along the lower frame edge 71*c* of the window frame 70 (see FIG. 1), so that a part of the conductive film 20 does not overlap the frame edge of the window frame 70 while the window glass 100 for the vehicle is attached to the window frame 70. Accordingly, a contact between the conductive film 20 and the window frame 70 can be prevented. In addition, an adhesive pasted to a peripheral portion along the frame edge of the window frame 70 can be prevented from coming into contact with the conductive film 20. The adhesive bonds a peripheral portion along the glass edge of the glass plate 60 and a peripheral portion along the frame edge of the window frame 70.

It should be noted that the shortest distance between the lower-side outer edge 91 and the window frame 70 (more specifically, the lower frame edge 71*c*) is preferably equal to or more than 5 mm and equal to or less than 100 mm. Since the shortest distance is set to this kind of dimension, the lower-side outer edge 91 can be brought into proximity with the window frame 70 (more specifically, the lower frame edge 71*c*). For this reason, even when the width of the light shielding film 65 is narrow, at least a part of the antenna 1, more preferably, the entire antenna 1, is hidden by the light shielding film 65. As a result, the design of the window glass 100 for the vehicle and the design of the vehicle improve. The sizes of the shortest distance in the antenna 2 are similar to the sizes described above.

In FIG. 3, the conductive film 20 includes, for example, a step portion 130 that includes a plurality of slot edges 135, 136 extending in parallel with the direction in which the horizontal slot 12 extends, and that changes the slot width of the left wide slot 15 in a stepwise manner with the plurality of slot edges 135, 136. The step portion 130 improves the return loss characteristics of the antenna 1. In addition, since one of the slot edges is formed in a stepwise manner, the current path is extended and the degree of coupling with an opposing slot edge is changed, so that the frequency characteristics of the antenna gain are flattened. The step portion 130 includes two steps, i.e., the slot edges 135, 136, and is formed between the virtual extension line extending in the direction in which the horizontal slot 12 extends and the slot lower edge of the left wide slot 15. The left wide slot 15 includes slot portions 131 to 134.

The slot portion 131 includes one end connected at the connection point 12*e* to the another end of the horizontal slot 12. The slot portion 131 is inclined toward the upper-side outer edge 92 with respect to the virtual extension line extending in the direction in which the horizontal slot 12 extends. The slot width of the slot portion 131 is substantially the same as the slot width of the horizontal slot 12.

The slot portion 132 includes one end connected to another end of the slot portion 131. The slot portion 132 is formed by the slot edge 135 and the slot edge 138 both of which are in parallel with the direction in which the horizontal slot 12 extends. The slot width of the slot portion 132 is substantially the same as the slot width of the slot portion 131.

The slot portion 133 includes one end connected to another end of the slot portion 132. The slot portion 133 is formed by the slot edge 136 and a slot edge 139. The slot edge 136 is in parallel with the virtual extension line extending in the direction in which the horizontal slot 12 extends. The slot edge 139 is inclined toward the upper-side outer edge 92 with respect to the virtual extension line. The slot width of the slot portion 133 is wider than the slot width of the slot portion 132, and the slot width of the slot portion 133 gradually increases away from the one end of the slot portion 133 toward the another end of the slot portion 133.

The slot portion 134 includes one end connected to another end of the slot portion 133 and another end (open end 15*a*) that is open through the upper-side outer edge 92. The open end 15*a* represents an open end of the left wide slot 15. The upper-side outer edge 92 is divided by the open end 15*a* into the upper edge left portion 111 and the upper edge right portion 112. The slot width of the slot portion 134 is substantially the same as the slot width of the slot portion 133. The slot portion 134 extends in parallel with the vertical slot 11.

The step portion 130 includes an inclined slot edge 137 which is a slot edge for a slot portion connecting the slot portion 133 and the slot portion 134. The inclined slot edge 137 improves the return loss characteristics of the antenna 1. The inclined slot edge 137 is inclined toward the upper-side outer edge 92 with respect to the slot edge 136.

Figure 4:
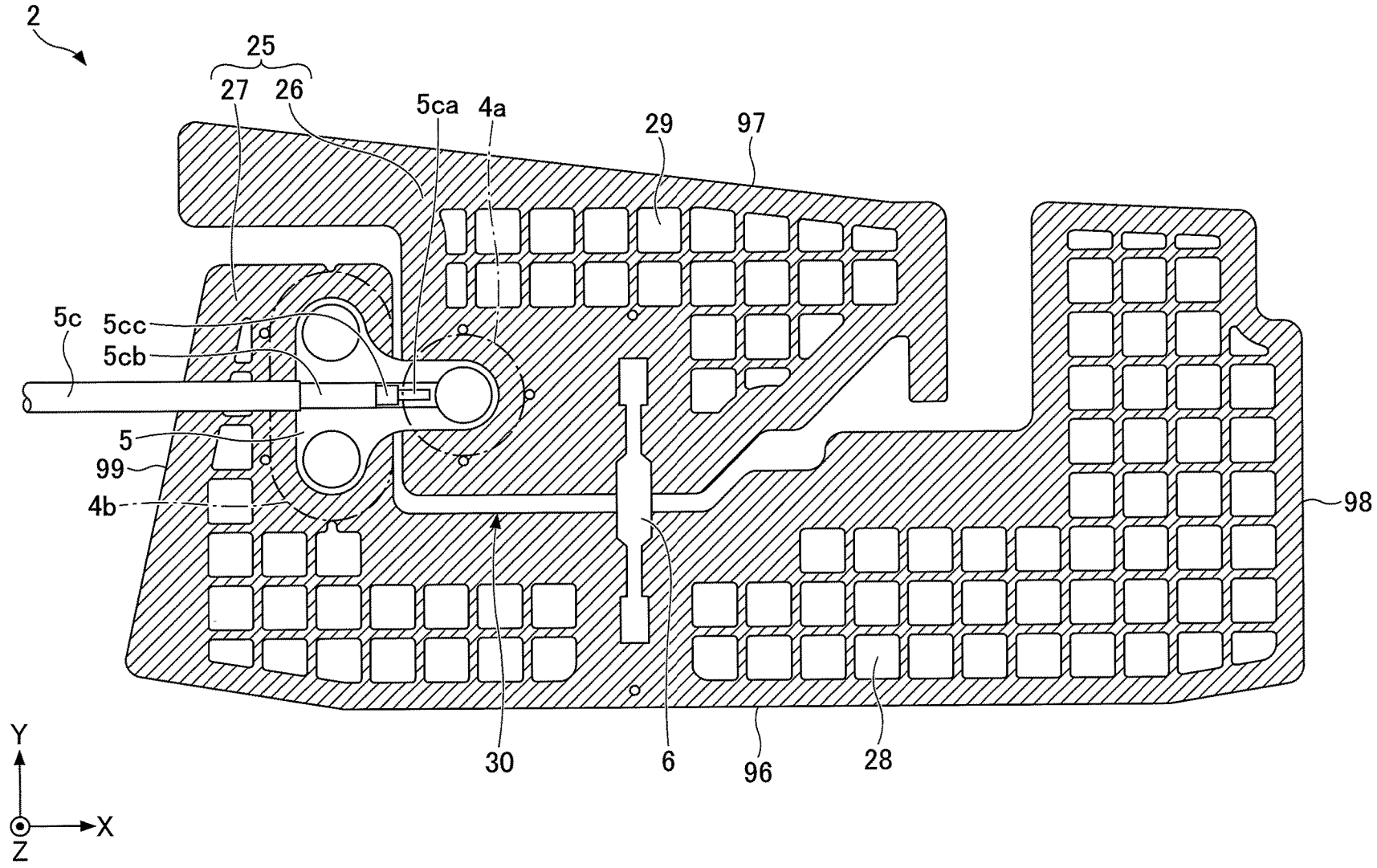
FIG. 4 is a drawing illustrating an example of a state in which a coaxial cable is connected to a pair of feeding points in an antenna according to a second embodiment.

FIG. 4 is a drawing illustrating an example of a state in which a coaxial cable 5*c* is connected to a pair of feeding points 4*a*, 4*b* in the antenna 2 according to a second embodiment. FIG. 4 illustrates a state in which one end of the coaxial cable 5*c* is indirectly connected by the connector 5 to the core-side feeding point 4*a* and to the ground-side feeding point 4*b* of the antenna 2.

In the second embodiment, descriptions about configurations and effects similar to those of the first embodiment will be omitted or simplified by referring to the above descriptions.

The core-side feeding point 4*a*, the ground-side feeding point 4*b*, the coaxial cable 5*c*, a core wire 5*ca*, an outer conductor 5*cb*, an insulator 5*cc*, a connector 5, and a resistor 6 have configurations similar to the core-side feeding point 7*a*, the ground-side feeding point 7*b*, the coaxial cable 8*c*, the core wire 8*ca*, the outer conductor 8*cb*, the connector 8, and the resistor 9, respectively.

The antenna 2 is a slot antenna formed with a conductive film 25. The antenna 2 functions as a slot antenna with a slot 30 (elongated cutout) formed in the conductive film 25. In the second embodiment, the conductive film 25 includes a lower-side outer edge 96 and an upper-side outer edge 97, which are opposite to each other in the Y axis direction, and includes a right-side outer edge 98 and a left-side outer edge 99, which are opposite to each other in the X axis direction perpendicular to the Y axis direction.

In the second embodiment, the Y axis direction is an example of the first direction, and the X axis direction is an example of the second direction different from the first direction. The left-side outer edge 99 is an example of one outer edge. The upper-side outer edge 97 is an example of another outer edge. The lower-side outer edge 96 is an example of a third outer edge. The right-side outer edge 98 is an example of a fourth outer edge.

The conductive film 25 includes a core-side conductor 26 extending to a first side with respect to the slot 30 and a ground-side conductor 27 extending to a second side with respect to the slot 30. In the present embodiment, in an area where the core-side feeding point 4*a*, the ground-side feeding point 4*b*, and the resistor 6 are not formed, the core-side conductor 26 is formed with a lattice-shaped hole-formed portion 29, and the ground-side conductor 27 is formed with a lattice-shaped hole-formed portion 28.

Figure 5:
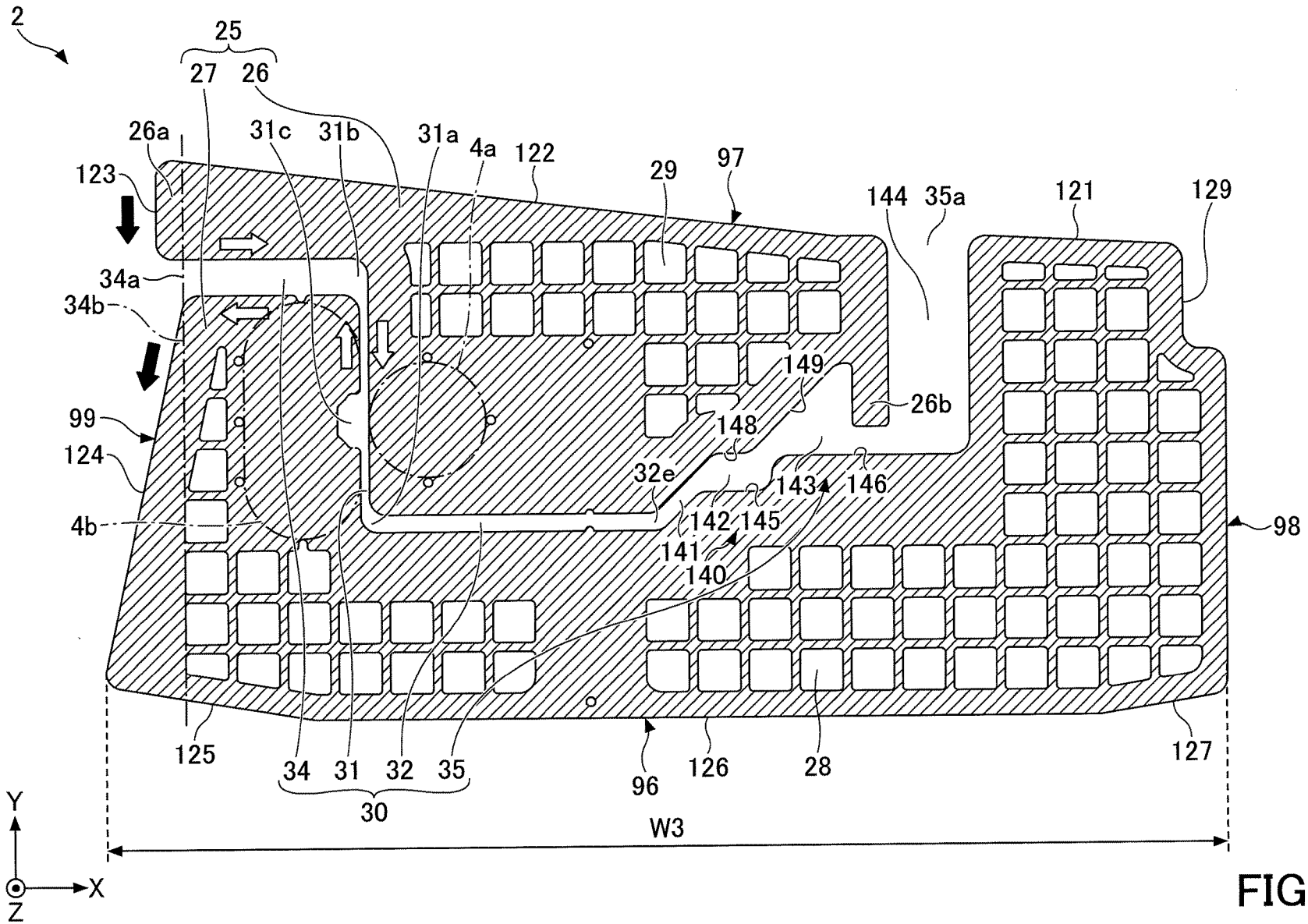
FIG. 5 is a plan view illustrating a configuration example of the antenna according to the second embodiment.

FIG. 5 is a plan view illustrating a configuration example of the antenna 2 according to the second embodiment. FIG. 5 illustrates a state in which the connector 5 (see FIG. 4) connected to one end of the coaxial cable 5*c* is detached from the conductive film 25 with which the antenna 2 is formed.

The conductive film 25 with which the antenna 2 is formed includes: the lower-side outer edge 96 and the upper-side outer edge 97, which are opposite to each other in the Y axis direction; the right-side outer edge 98 and the left-side outer edge 99, which are opposite to each other in the X axis direction; and a feeding portion including the core-side feeding point 4*a* and the ground-side feeding point 4*b*, which are opposite to each other in the X axis direction. In FIG. 5, the lower-side outer edge 96 includes a lower edge left portion 125, a lower edge intermediate portion 126, and a lower edge right portion 127. The upper-side outer edge 97 includes an upper edge right portion 121 and an upper edge left portion 122. The left-side outer edge 99 of FIG. 5 includes at least one straight portion. The right-side outer edge 98 of FIG. 5 includes a corner portion 129 in an upper portion of the right-side outer edge 98. The shape of the right-side outer edge 98 is in a stepped shape. The left-side outer edge 99 includes a left edge upper portion 123 and a left edge lower portion 124.

The conductive film 25 includes a slot 30. The slot 30 includes a vertical slot 31, a horizontal slot 32, a left wide slot 34, and a right wide slot 35. The left wide slot 34, the vertical slot 31, the horizontal slot 32, and the right wide slot 35 are connected consecutively in this order.

The vertical slot 31 is an example of a first slot. The vertical slot 31 extends in the Y axis direction between the core-side feeding point 4*a* and the ground-side feeding point 4*b*. The vertical slot 31 includes one end located at the same side as the lower-side outer edge 96 in the Y axis direction and another end located at the same side as the upper-side outer edge 97 in the Y axis direction.

The horizontal slot 32 is an example of the second slot. The horizontal slot 32 includes one end connected at a connection point 31*a* with the another end of the vertical slot 31 at the same side as the lower-side outer edge 96. The horizontal slot 32 extends in the X axis direction at the same side as the right-side outer edge 98 with respect to the vertical slot 31.

The left wide slot 34 is an example of the third slot. The left wide slot 34 includes one end connected at a connection point 31*b* with the another end of the vertical slot 31 at the same side as the upper-side outer edge 97 and another end (open end 34*a*) that is open through the left-side outer edge 99. The connection point 31*b* is located at a side opposite the connection point 31*a* with respect to a portion where the vertical slot 31 is sandwiched between the core-side feeding point 4*a* and the ground-side feeding point 4*b*. The left wide slot 34 extends at one side of the vertical slot 31 opposite from the horizontal slot 32. More specifically, the left wide slot 34 extends in the X axis direction at the same side as the left-side outer edge 99 with respect to the vertical slot 31. The left wide slot 34 has a portion of which slot width is wider than the vertical slot 31.

The right wide slot 35 is an example of the fourth slot. The right wide slot 35 includes one end connected at a connection point 32*e* with another end of the horizontal slot 32 at the same side as the right-side outer edge 98. The right wide slot 35 extends at one side of the horizontal slot 32 opposite from the vertical slot 31. More specifically, the horizontal slot 32 is located between the vertical slot 31 and the right wide slot 35. The right wide slot 35 extends at the same side as the upper-side outer edge 97 with respect to a virtual extension line extending in a direction in which the horizontal slot 32 extends. The right wide slot 35 has a portion of which slot width is wider than the horizontal slot 32.

In the antenna 2 according to the second embodiment, the vertical slot 31, the horizontal slot 32, the left wide slot 34, and the right wide slot 35 are formed with the conductive film 25. Therefore, the antenna 2 can support a plurality of wide frequency bands. The antenna 2 having the shape illustrated in FIG. 5 is particularly suitable for transmitting and receiving electromagnetic waves used for ISM. In the antenna 2 according to the second embodiment, the horizontal slot 32, the left wide slot 34, and the right wide slot 35 have a slot component that extends in a substantially horizontal direction when the antenna 2 is attached to the vehicle. Therefore, the antenna 2 is suitable for transmitting and receiving vertically polarized electromagnetic waves.

It should be noted that when the antenna 2 is attached so that the horizontal slot 32, the left wide slot 34, and the right wide slot 35 have a slot component that extends in a substantially vertical direction when the antenna 2 is attached to the vehicle, the antenna 2 is suitable for transmitting and receiving horizontally polarized electromagnetic waves.

In FIG. 5, the left-side outer edge 99 has the left edge lower portion 124 as an inclined portion that is inclined with respect to the virtual line 34*b* and that extends at one side of the virtual line 34*b* opposite from the left wide slot 34. Since an inclined portion such as the left edge lower portion 124 extends, a current excited along the left-side outer edge 99 (i.e., a current contributing to radiation of the antenna 2) increases. As a result, the antenna gain of the antenna 2 increases. For example, the left edge lower portion 124 is inclined with respect to the virtual line 34*b* in such a manner that a maximum external dimension W3 of the conductive film 25 in the X axis direction increases.

Alternatively, the left edge lower portion 124 may be configured to extend to an intermediate point along the virtual line 34*b* from the open end 34*a*, and the left edge lower portion 124 may be inclined from the intermediate point with respect to the virtual line 34*b*. The inclined portion that is inclined with respect to the virtual line 34*b* and that extends at one side of the virtual line 34*b* opposite from the left wide slot 34 may be any one of or both of the left edge upper portion 123 and the left edge lower portion 124. Even in an aspect in which the left-side outer edge 99 has an inclined portion that is inclined with respect to the virtual line 34*b* and that extends at the same side as the left wide slot 34 with respect to the virtual line 34*b*, the antenna gain of the antenna 2 improves, and the antenna 2 functions as a slot antenna operating at frequencies in wide frequency ranges.

In FIG. 5, the conductive film 25 may have a recessed portion 31*c* partially expanding a slot width of the vertical slot 31. The recessed portion 31*c* improves the return loss characteristics of the antenna 2 and the antenna gain. The recessed portion 31*c* can suppress fluctuations in the characteristic of the antenna 2, even when the position where the connector 5 is mounted on the feeding portion is slightly shifted. In addition, the recessed portion 31*c* improves the ease of installation of the connector 5.

The upper-side outer edge 97 includes an upper edge left portion 122 as an example of a second inclined portion. Because of the existence of the second inclined portion such as the upper edge left portion 122, the size of the conductive film 25 in the Y axis direction can be reduced (in particular, the size in the Y axis direction can be reduced in a central area of the conductive film 25 in the X axis direction). The upper edge left portion 122 is formed along the light shielding film edge 65*c* (see FIG. 1) so that a part of the conductive film 25 is not exposed from the light shielding film 65. As a result, the design of the window glass 100 for the vehicle and the design of the vehicle improve.

The lower-side outer edge 96 includes the lower edge left portion 125 as an example of the third inclined portion. Because of the existence the third inclined portion such as the lower edge left portion 125, the size of the conductive film 25 in the Y axis direction can be reduced (in particular, the size in the Y axis direction can be reduced in a left end area of the conductive film 25 in the X axis direction). The lower edge left portion 125 is formed along the lower frame edge 71*c* of the window frame 70 (see FIG. 1), so that a part of the conductive film 25 does not overlap the frame edge of the window frame 70 while the window glass 100 for the vehicle is attached to the window frame 70. Accordingly, a contact between the conductive film 25 and the window frame 70 can be prevented. In addition, an adhesive pasted to a peripheral portion along the frame edge of the window frame 70 can be prevented from coming into contact with the conductive film 25.

In FIG. 5, the conductive film 25 includes, for example, a step portion 140 that includes a plurality of slot edges 145, 146 extending in parallel with the direction in which the horizontal slot 32 extends, and that changes the slot width of the right wide slot 35 in a stepwise manner with the plurality of slot edges 145, 146. The step portion 140 improves the return loss characteristics of the antenna 2. The step portion 140 includes two steps, i.e., the slot edges 145, 146, and is formed between the virtual extension line extending in the direction in which the horizontal slot 32 extends and the slot lower edge of the right wide slot 35. The right wide slot 35 includes slot portions 141 to 144.

The slot width of the slot portion 141 is substantially the same as the slot width of the horizontal slot 32. The slot portion 142 is formed by the slot edge 145 and the slot edge 148 both of which are in parallel with the direction in which the horizontal slot 32 extends. The slot width of the slot portion 142 is wider than the slot width of the slot portion 141. The slot portion 143 is formed by a slot edge 146 and a slot edge 149. The slot edge 146 is in parallel with the virtual extension line extending in the direction in which the horizontal slot 32 extends. The slot edge 149 is inclined toward the upper-side outer edge 97 with respect to the virtual extension line extending in the direction in which the horizontal slot 32 extends. The slot width of the slot portion 143 is wider than the slot width of the slot portion 142, and the slot width of the slot portion 143 gradually increases away from the one end of the slot portion 143 toward the another end of the slot portion 143. The slot portion 144 includes one end connected to another end of the slot portion 143 and another end (open end 35*a*) that is open through the upper-side outer edge 97. The open end 35*a* represents an open end of the right wide slot 35. The upper-side outer edge 97 is divided by the open end 35*a* into the upper edge right portion 121 and the upper edge left portion 122. The slot width of the slot portion 144 is substantially the same as the slot width of the slot portion 143. The slot portion 144 extends in parallel with the vertical slot 31.

The conductive film 25 includes a protruding portion 26*b* partially narrowing the slot width of the right wide slot 35. The protruding portion 26*b* improves the antenna gain of the antenna 2. The protruding portion 26*b* is formed to protrude in the Y axis direction from the core-side conductor 26, i.e., extend toward the lower-side outer edge 96 from a portion at the same side as the upper-side outer edge 97.

The conductive film 25 includes an upper-side outer edge 97 and a right-side outer edge 98, i.e., an example of a pair of an outer edge forming the corner portion 129 of the conductive film 25. The upper-side outer edge 97 includes the open end 35*a* of the right wide slot 35, and the right-side outer edge 98 extends at one side of the right wide slot 35 opposite from the horizontal slot 32. The corner portion 129, where the upper-side outer edge 97 and the right-side outer edge 98 intersect, is recessed toward the inside of the conductive film 25. Since the corner portion 129 is recessed toward the inside, the antenna gain of the antenna 2 improves. In the corner portion 129, a length recessed in the Y axis direction with respect to the upper-side outer edge 97 is longer than a length recessed in the X axis direction with respect to the right-side outer edge 98.

Figure 6:
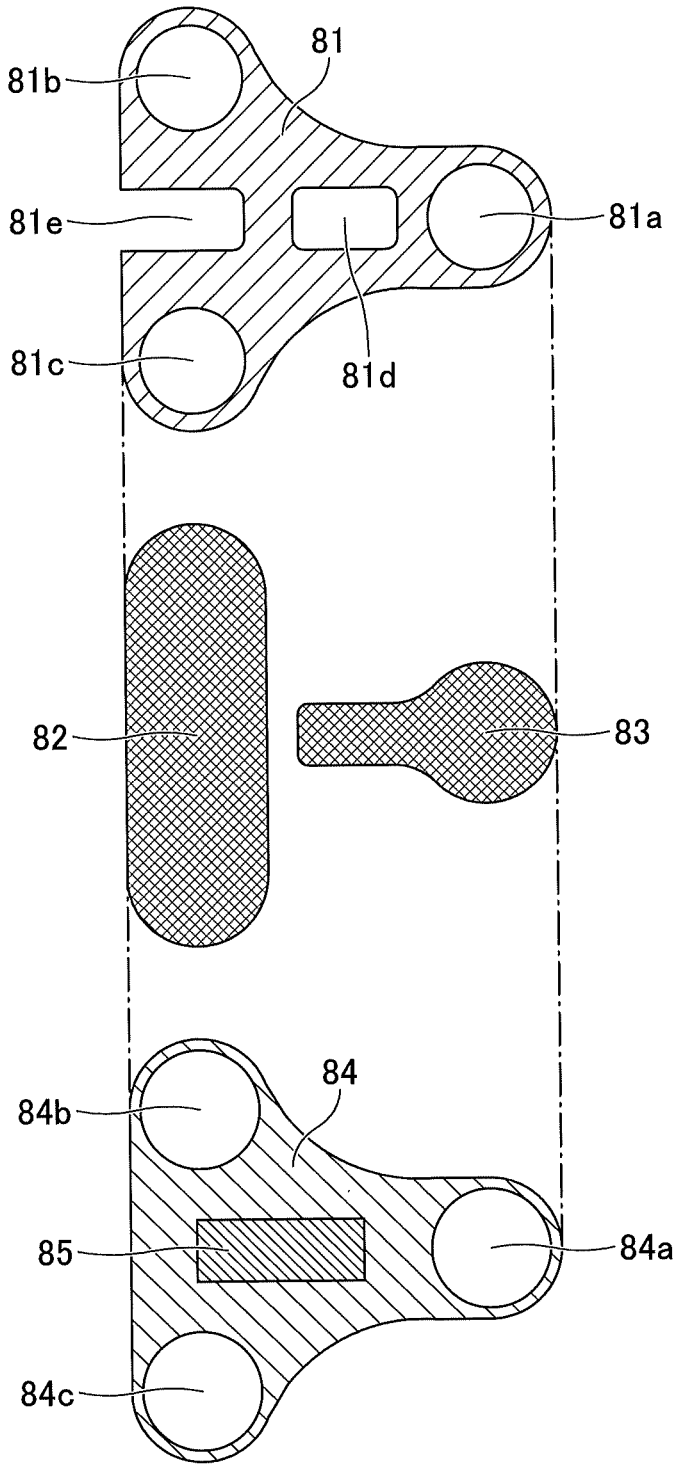
FIG. 6 is an exploded view illustrating a connector for supplying power to an antenna.

FIG. 6 is an exploded view illustrating a connector for supplying power to an antenna. The connector illustrated in FIG. 6 corresponds to the connector 5 or the connector 8 described above. The connector has a three-layer structure in which first to third layers are stacked in the Z axis direction.

The upper layer 81 is an example of a first layer, and is an insulating layer having a substantially T-shaped outer shape. The upper layer 81 is a resin layer such as, for example, a polyimide film. Openings 81*a*, 81*b*, and 81*c* penetrating the upper layer 81 are provided at three vertices of a substantially T-shape. The opening 81*b* is formed in one of side portions of the substantially T-shape, and the opening 81*c* is formed in the other of the side portions of the substantially T-shape. The opening 81*a* is formed in a trunk portion of the substantially T-shape. Between the opening 81*b* and the opening 81*c*, an opening 81*e* penetrating the upper layer 81 is famed. Between the opening 81*e* and the opening 81*a*, an opening 81*d* penetrating the upper layer 81 is famed. The openings 81*a*, 81*b*, and 81*c* have circular shapes. The opening 81*e* has a notch shape, one end of which is open. The opening 81*d* has a substantially rectangular shape.

The lower layer 84 is an example of the third layer, and is an insulating layer having a substantially T-shaped outer shape. The lower layer 84 is a resin layer such as, for example, a polyimide film. Openings 84*a*, 84*b*, and 84*c* penetrating the lower layer 84 are provided at three vertices of a substantially T-shape. The opening 84*b* is formed in one of side portions of the substantially T-shape, and the opening 84*c* is formed in the other of the side portions of the substantially T-shape. The opening 84*a* is formed in a trunk portion of the substantially T-shape. The openings 84*a*, 84*b*, and 84*c* have circular shapes. A central portion of the lower layer 84 corresponds to a contact surface (an attachment surface of the connector) where the connector comes into contact with the recessed portion 11*c* (see FIG. 3) or the recessed portion 31*c* (see FIG. 5). An adhesive member 85 such as a double-sided tape is attached to the surface of the central portion of the lower layer 84.

The middle layers 82, 83 are examples of a second layer, and is a layer sandwiched by the first layer and the third layer. The middle layer 82 is a conductor layer including, in a state where the middle layer 82 is sandwiched between the upper layer 81 and the lower layer 84, a portion facing the openings 81*b*, 84*b*, a portion facing the openings 81*c*, 84*c*, and a portion connecting between these portions. The middle layer 83 is a conductor layer including, in a state where the middle layer 83 is sandwiched between the upper layer 81 and the lower layer 84, a portion facing the openings 81*a*, 84*a*, a portion facing the opening 81*d*, and a portion connecting between these portions. The middle layers 82, 83 are not electrically connected with each other. The middle layers 82, 83 are, for example, metal layers made of copper, silver, or the like.

In this manner, the connector connecting a coaxial cable to the antenna has a three-layer structure in which the middle layers 82, 83 are sandwiched between the upper layer 81 and the lower layer 84. One end of the coaxial cable is arranged on the upper layer 81 of the connector having the layer structure described above. A tip of the core wire of the coaxial cable is bonded with the middle layer 83 through the opening 81*d* by solder or the like. Therefore, the core wire is electrically connected to the core-side feeding point 7*a* facing the opening 84*a* via the middle layer 83. The outer conductor of the coaxial cable is bonded with the middle layer 82 through the opening 81*e* by solder or the like. The outer conductor is electrically connected to the ground-side feeding point 7*b* facing the openings 84*b*, 84*c* via the middle layer 82.

First Example

The first example illustrates a result obtained by measuring an antenna gain of the antenna 1 according to the first embodiment (FIGS. 2, 3) and an antenna that did not have an inclined right edge lower portion 114 (hereinafter referred to as "comparative antenna"). The antenna 1 had a right edge lower portion 114 inclined with respect to the virtual line 14*b*. In contrast, the comparative antenna did not have an inclined portion such as the right edge lower portion 114.

The antenna gain was measured by setting, in the center of a turn table, a center of a vehicle on which a rear glass attached with an antenna was installed. At this time, the rear glass was inclined about 20 degrees with respect to the horizontal plane. Then, a vertically polarized electromagnetic wave and a horizontally polarized electromagnetic wave were transmitted from a transmission antenna, and the antenna gains for the vertical polarization and the horizontal polarization were measured by changing an elevation θe with respect to the antenna and an azimuth θr in a horizontal plane with respect to the antenna. When the transmission antenna was in a plane in parallel with the ground, the elevation θe was defined as 0 degrees, and when the transmission antenna was in the zenith direction, the elevation θe was defined as 90 degrees. When the transmission antenna was in front of the vehicle, the azimuth θr was defined as 0 degrees, and when the transmission antenna was at sides of the vehicle, the azimuth θr was defined as ±90 degrees. This is also applicable to the examples explained below, unless otherwise specified.

While the elevation θe was changed by 2 degrees from 0 degrees to 20 degrees, and the azimuth θr was changed by 2 degrees from 0 degrees to 360 degrees, average values of antenna gains for the vertical polarization and the horizontal polarization measured at every 10 MHz in each frequency band of LTE were adopted as a vertical polarization average antenna gain and a horizontal polarization average antenna gain, respectively. A combination of a vertical polarization average antenna gain and a horizontal polarization average antenna gain was adopted as a vertical-polarization-and-horizontal-polarization-combined average antenna gain. In the examples described below, unless otherwise specified, the vertical-polarization-and-horizontal-polarization-combined average antenna gain will be referred to as an average antenna gain. The frequency bands of LTE here are considered to include three bands, i.e., 698 GHz to 0.96 GHz (low band), 1.71 GHz to 2.17 GHz (medium band), and 2.5 GHz to 2.69 GHz (high band). This is also applicable to the examples described later, unless otherwise specified.

With regard to the average antenna gain, an obtained result was that the antenna 1 having the inclined right edge lower portion 114 achieved an antenna gain 0.1 dB higher in the low band, an antenna gain 0.4 dB higher in the medium band, and an antenna gain 0.2 dB higher in the high band than the corresponding antenna gains of the comparative antenna that did not have an inclined right edge lower portion 114.

Second Example

Figure 7:
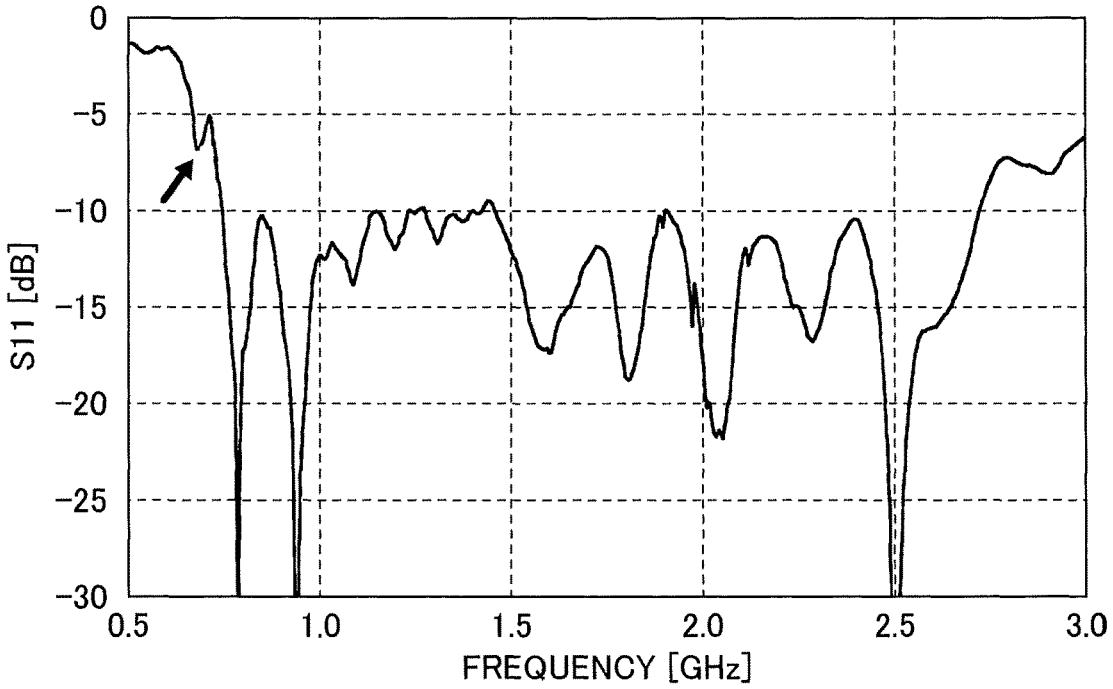
FIG. 7 is a graph illustrating a return loss in a case where the antenna according to the first embodiment does not have any recessed portion.
Figure 8:
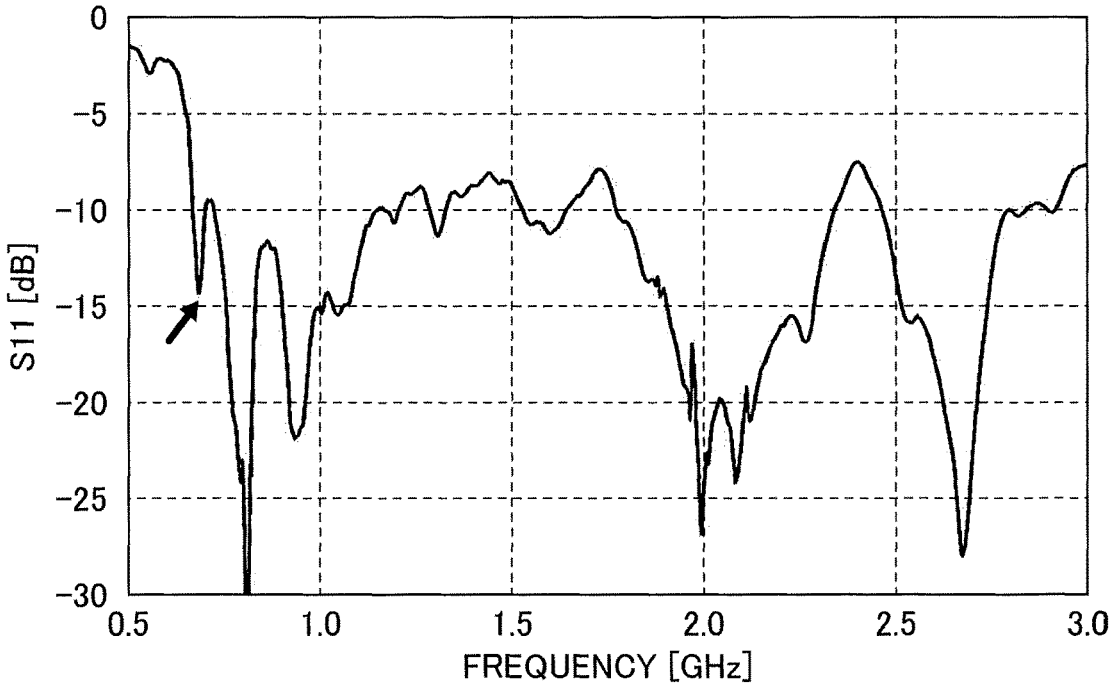
FIG. 8 is a graph illustrating a return loss in a case where the antenna according to the first embodiment includes a recessed portion.

FIG. 7 is a graph illustrating a return loss in a case where the antenna 1 according to the first embodiment did not have the recessed portion 11*c*. FIG. 8 is a graph illustrating a return loss in a case where the antenna 1 according to the first embodiment had the recessed portion 11*c*. When the recessed portion 11*c* was provided, the capacitive coupling between the core wire 8*ca* of the coaxial cable 8*c* and the ground-side feeding point 7*b* decreases. An obtained result was that the return loss characteristics of the antenna 1 in the low band improved (see black arrows in the figures) when the recessed portion 11*c* was provided as compared with when the recessed portion 11*c* was not provided.

Figure 9:
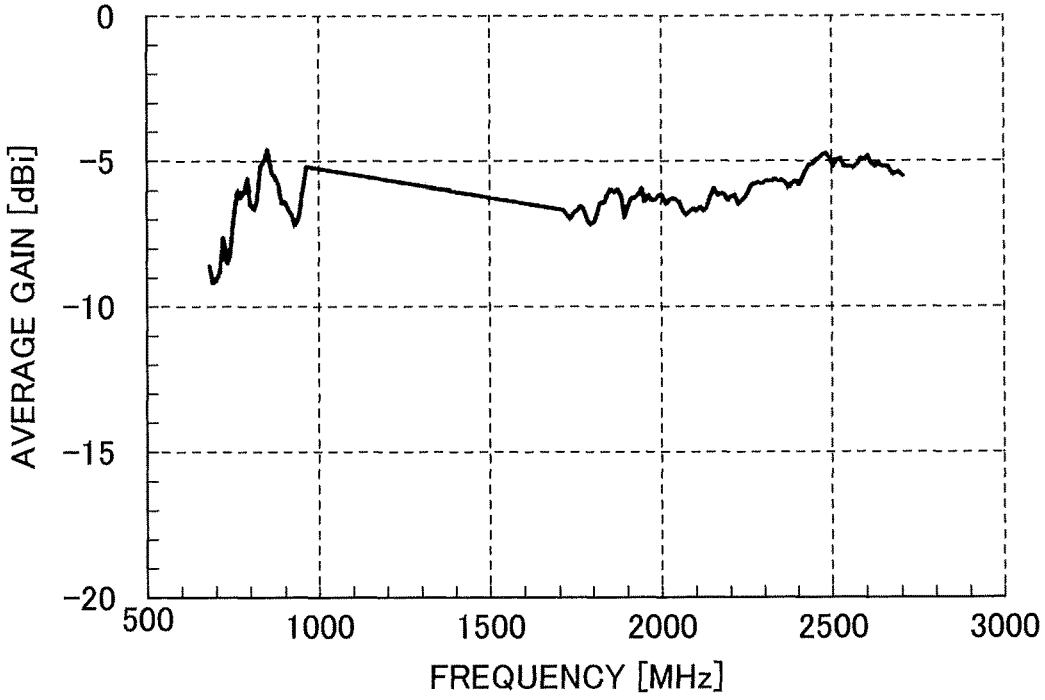
FIG. 9 is a graph illustrating frequency characteristics of an antenna gain in a case where the antenna according to the first embodiment does not have any recessed portion.
Figure 10:
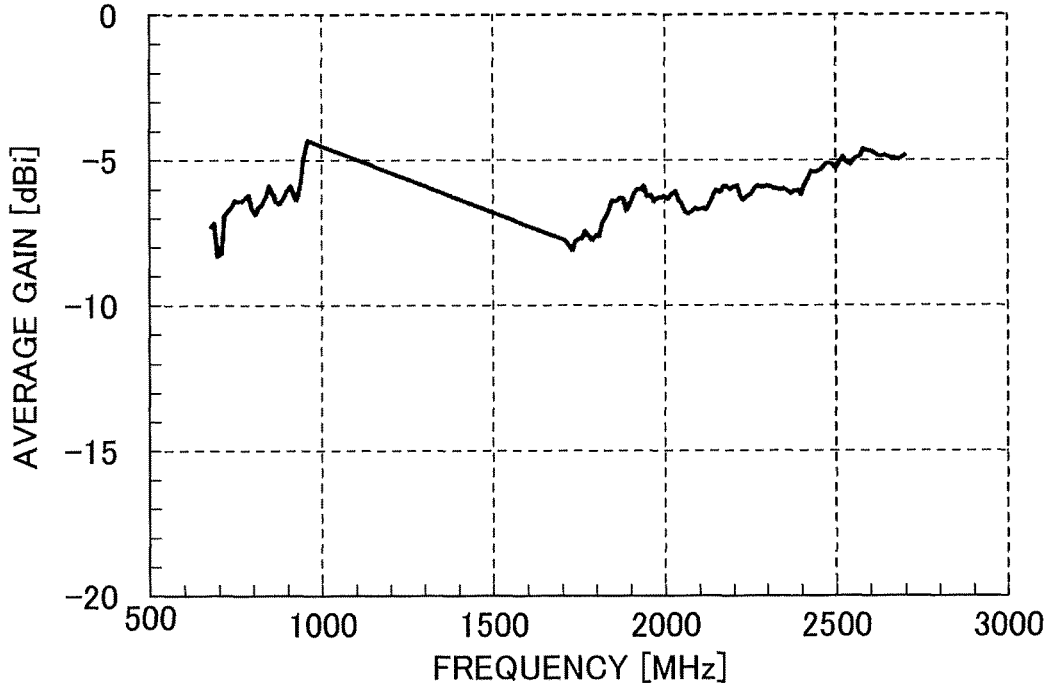
FIG. 10 is a graph illustrating frequency characteristics of an antenna gain in a case where the antenna according to the first embodiment has a recessed portion.

FIG. 9 is a graph illustrating frequency characteristics of an antenna gain in a case where the antenna 1 according to the first embodiment did not have the recessed portion 11*c*. FIG. 10 is a graph illustrating frequency characteristics of an antenna gain in a case where the antenna 1 according to the first embodiment had the recessed portion 11*c*. The vertical axis represents an average antenna gain.

As illustrated in the figures, the frequency characteristics of the average antenna gain of the antenna 1 in the low band was flattened when the recessed portion 11*c* was provided as compared with when the recessed portion 11*c* was not provided. When the recessed portion 11*c* was not provided, the average antenna gain of the antenna 1 in the low band was −6.4 dBi, and when the recessed portion 11*c* was provided, the average antenna gain of the antenna 1 in the low band was −6.2 dBi, which means that the antenna gain improved. When the recessed portion 11*c* was not provided, the average antenna gain of the antenna 1 in the high band was −5.1 dBi, and when the recessed portion 11*c* was provided, the average antenna gain of the antenna 1 in the high band was −4.8 dBi, which means that the antenna gain improved.

Third Example

Figure 11:
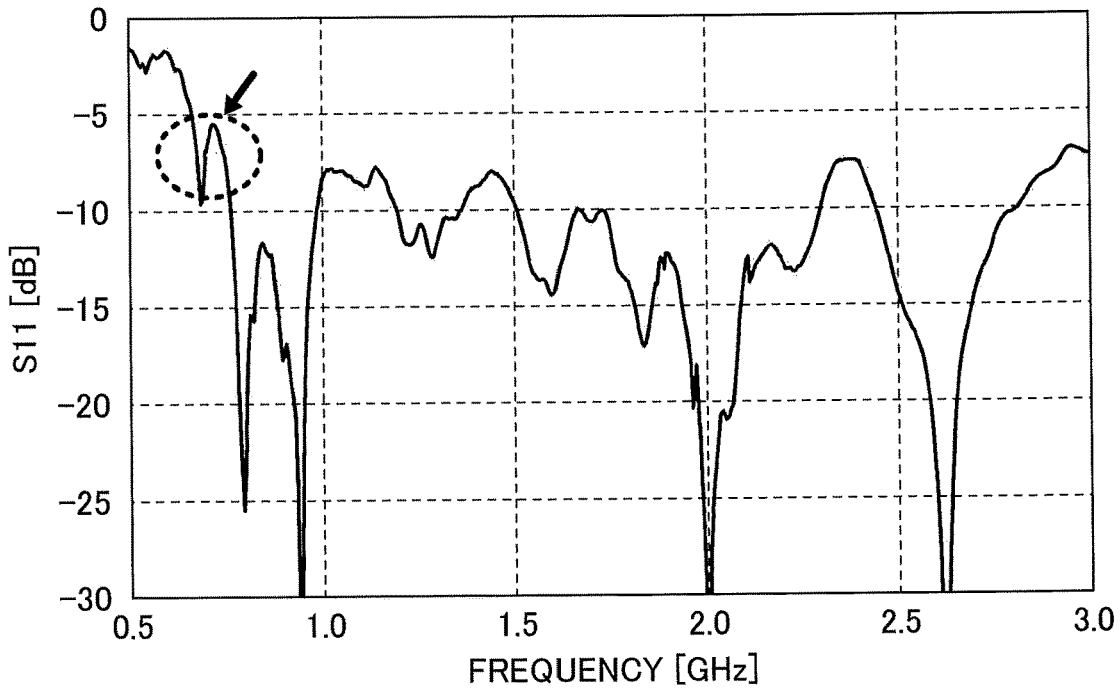
FIG. 11 is a graph illustrating a return loss in a case where the antenna according to the first embodiment does not have a step portion.
Figure 12:
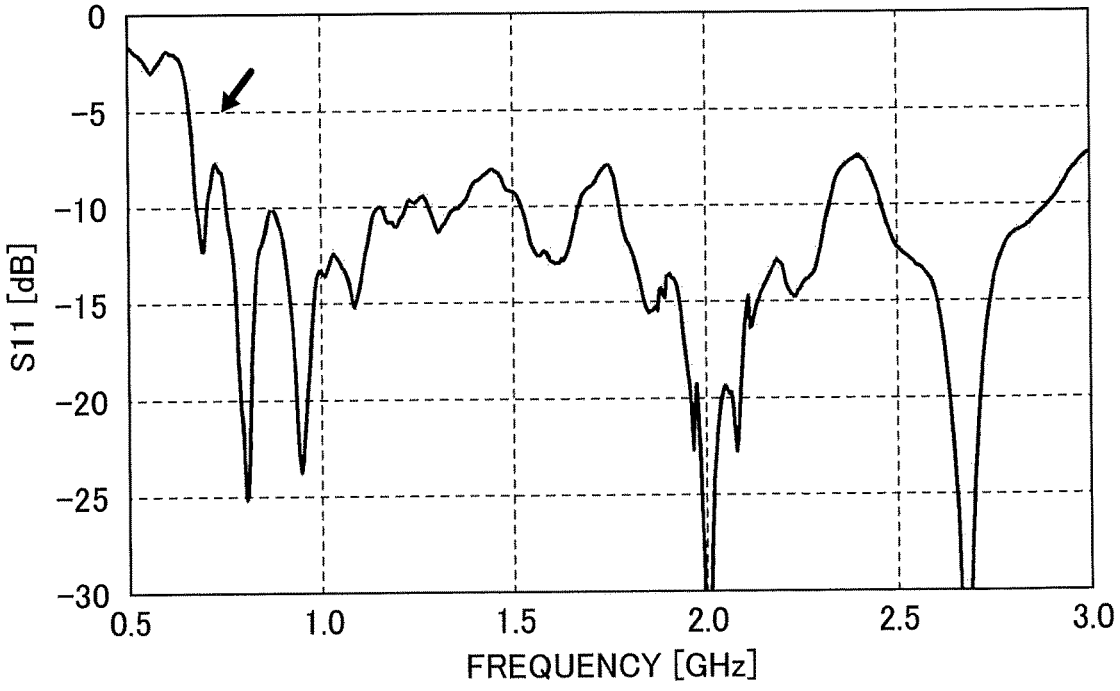
FIG. 12 is a graph illustrating a return loss in a case where the antenna according to the first embodiment has a step portion.

FIG. 11 is a graph illustrating a return loss in a case where the antenna 1 according to the first embodiment did not have the step portion 130. FIG. 12 is a graph illustrating a return loss in a case where the antenna 1 according to the first embodiment had the step portion 130. An obtained result was that the return loss characteristics of the antenna 1 in the low band improved (see black arrows in the figures) when the step portion 130 was provided as compared with when the step portion 130 was not provided.

Figure 13:
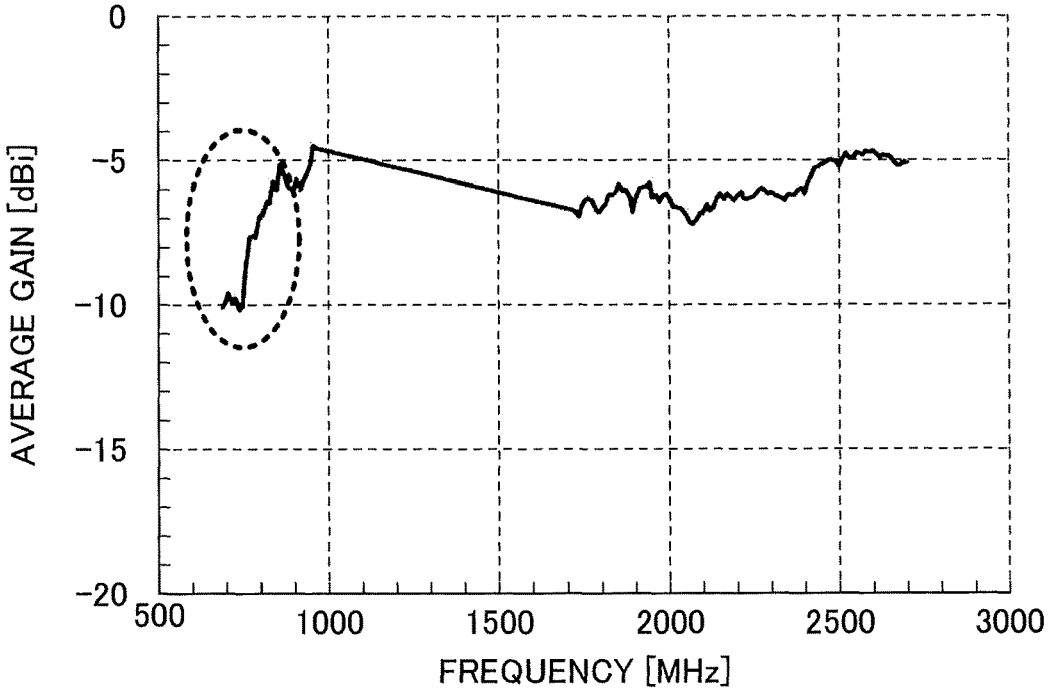
FIG. 13 is a graph illustrating frequency characteristics of an antenna gain in a case where the antenna according to the first embodiment does not have a step portion.
Figure 14:
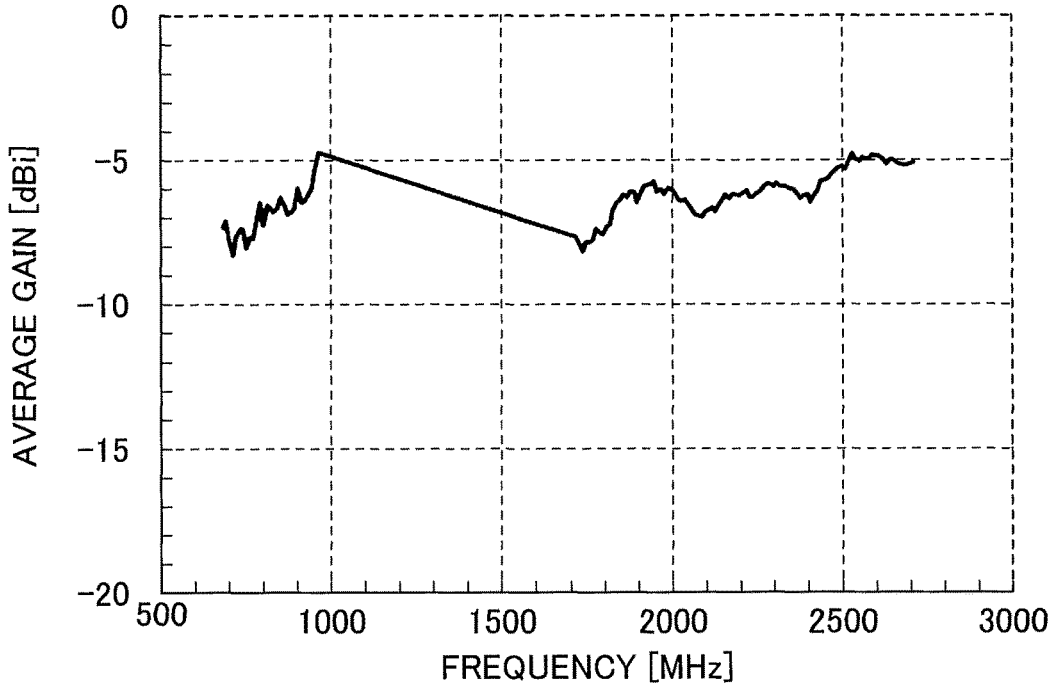
FIG. 14 is a graph illustrating frequency characteristics of an antenna gain in a case where the antenna according to the first embodiment has a step portion.

FIG. 13 is a graph illustrating frequency characteristics of an antenna gain in a case where the antenna 1 according to the first embodiment did not have the step portion 130. FIG. 14 is a graph illustrating frequency characteristics of an antenna gain in a case where the antenna 1 according to the first embodiment had the step portion 130. The vertical axis represents an average antenna gain. As illustrated in the figures, the frequency characteristics of the average antenna gain of the antenna 1 in the low band was flattened when the step portion 130 was provided as compared with when the step portion 130 was not provided.

Fourth Example

Figure 15:
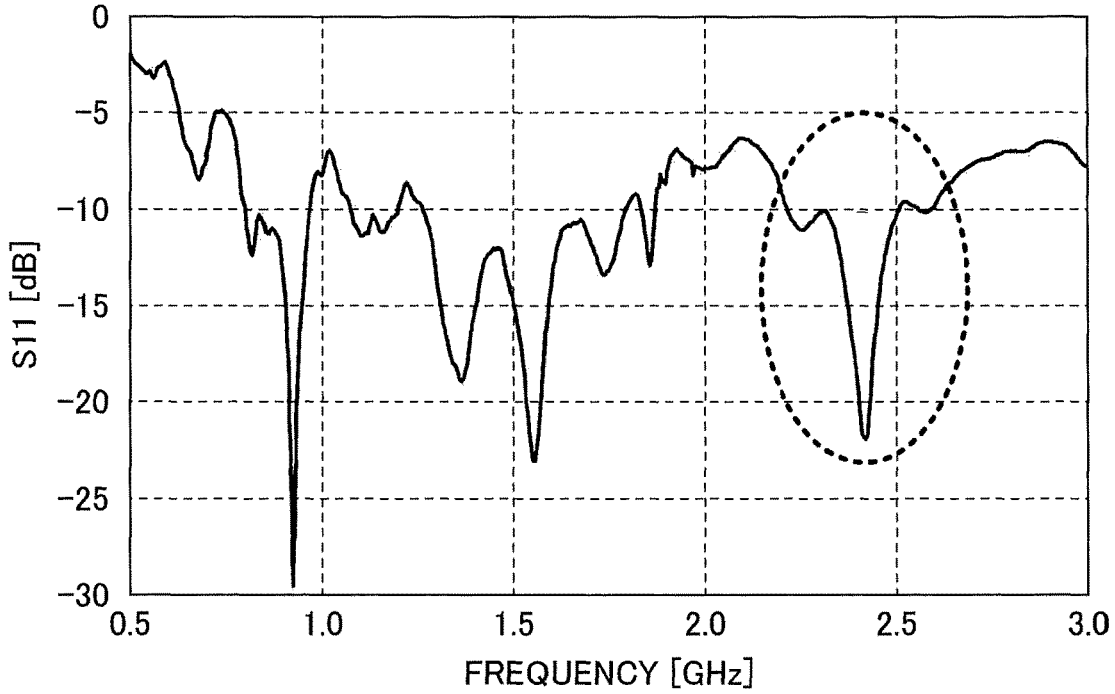
FIG. 15 is a graph illustrating a return loss in a case where the antenna according to the second embodiment does not have any protruding portion.
Figure 16:
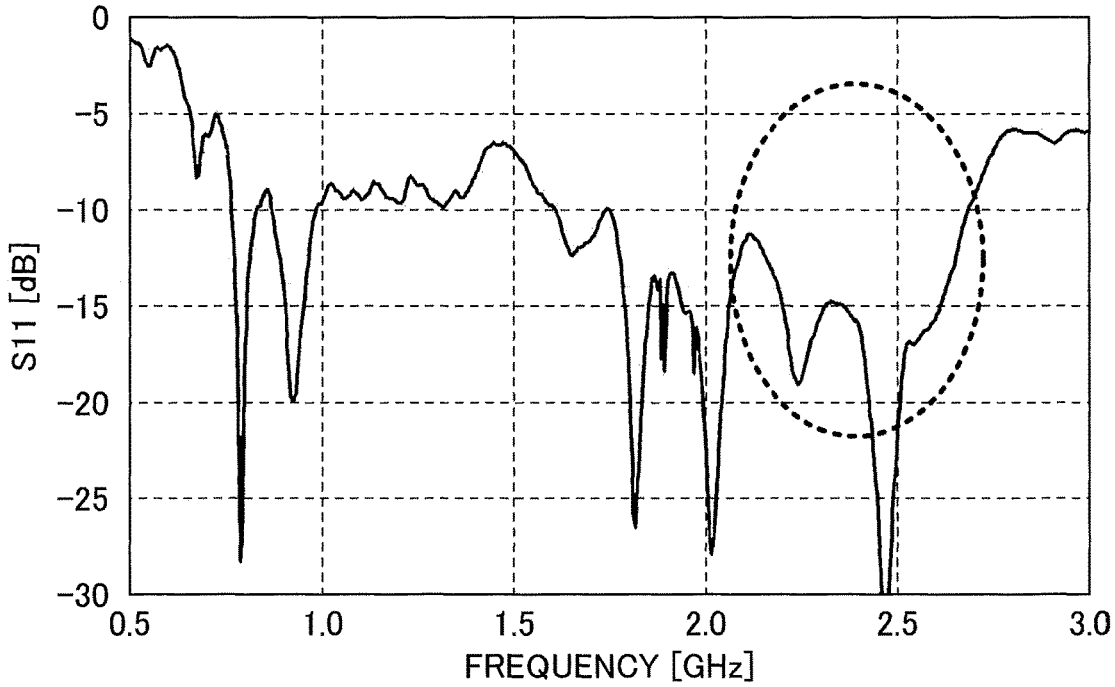
FIG. 16 is a graph illustrating a return loss in a case where the antenna according to the second embodiment has a protruding portion.

FIG. 15 is a graph illustrating a return loss in a case where the antenna 2 according to the second embodiment did not have the protruding portion 26*b*. FIG. 16 is a graph illustrating a return loss in a case where the antenna 2 according to the second embodiment had the protruding portion 26*b*. An obtained result was that the return loss characteristics of the antenna 2 in the high band improved when the protruding portion 26*b* was provided as compared with when the protruding portion 26*b* was not provided.

Figure 17:
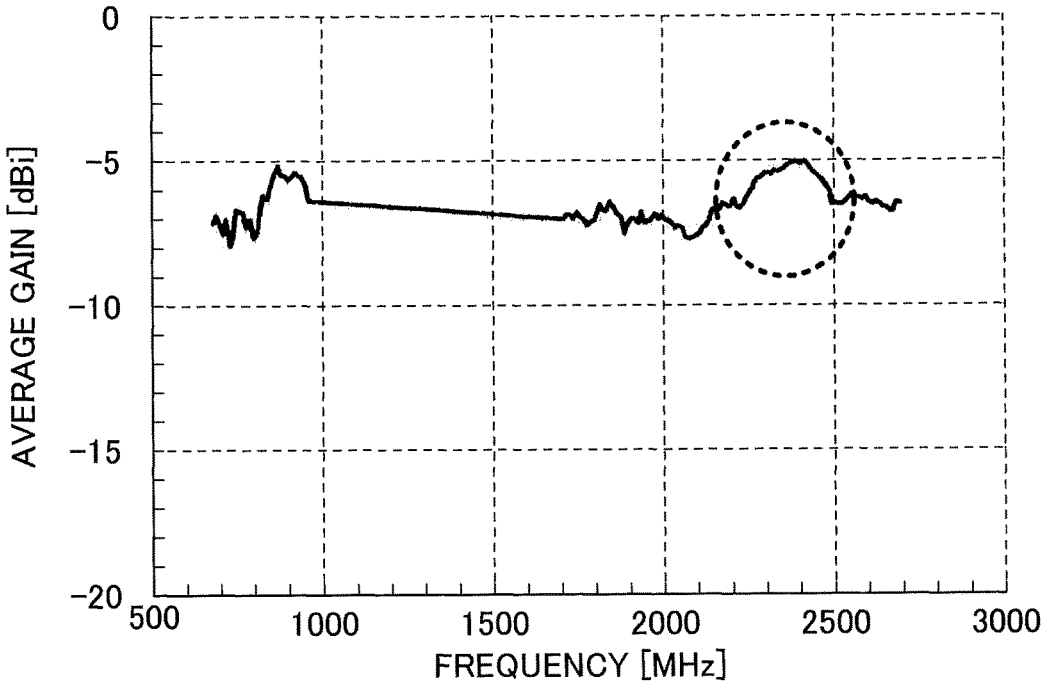
FIG. 17 is a graph illustrating frequency characteristics of an antenna gain in a case where the antenna according to the second embodiment does not have any protruding portion.
Figure 18:
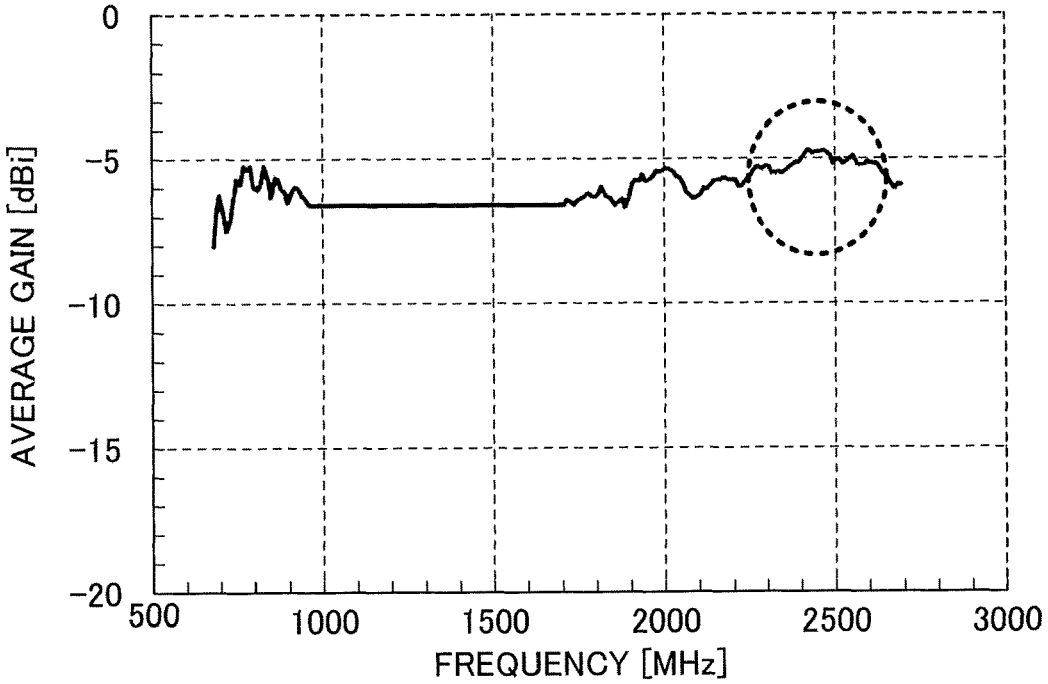
FIG. 18 is a graph illustrating frequency characteristics of an antenna gain in a case where the antenna according to the second embodiment has a protruding portion.

FIG. 17 is a graph illustrating frequency characteristics of an antenna gain in a case where the antenna 2 according to the second embodiment did not have the protruding portion 26*b*. FIG. 18 is a graph illustrating frequency characteristics of an antenna gain in a case where the antenna 2 according to the second embodiment had the protruding portion 26*b*. The vertical axis represents an average antenna gain. When the protruding portion 26*b* was not provided, the average antenna gain of the antenna 2 in the band of 2.4 GHz to 2.48 GHz of the ISM bands was −5.2 dBi, and when the protruding portion 26*b* was provided, the average antenna gain was −4.8 dBi, which means that the antenna gain improved.

Fifth Example

Figure 19:
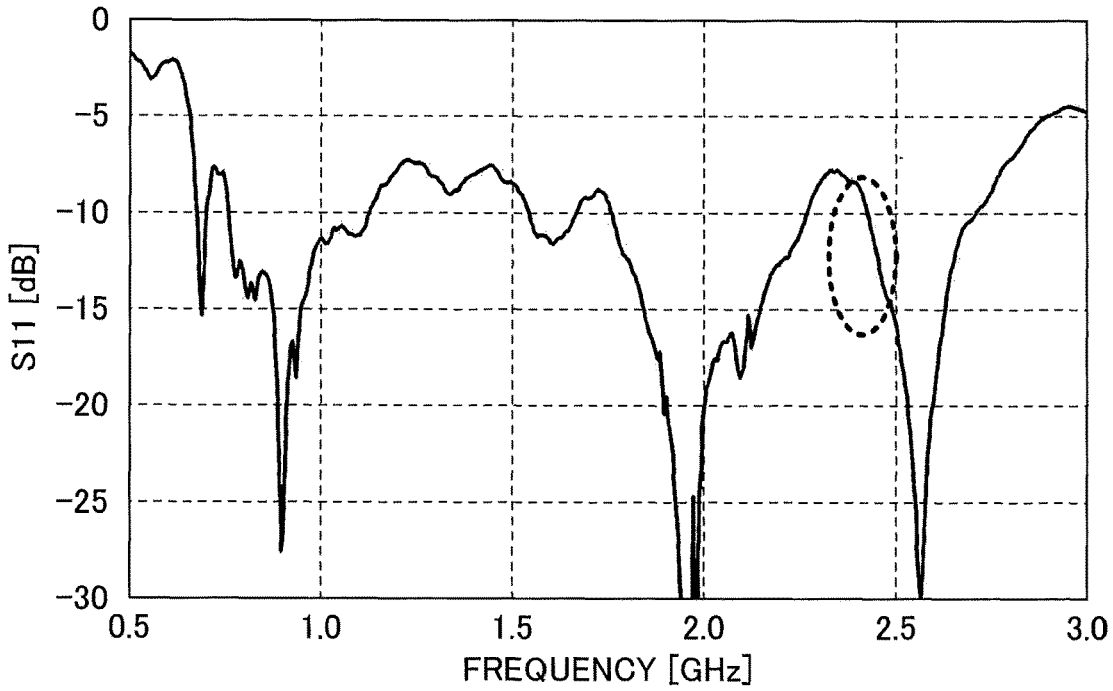
FIG. 19 is a graph illustrating a return loss in a case where a corner portion of the antenna according to the second embodiment is not recessed.
Figure 20:
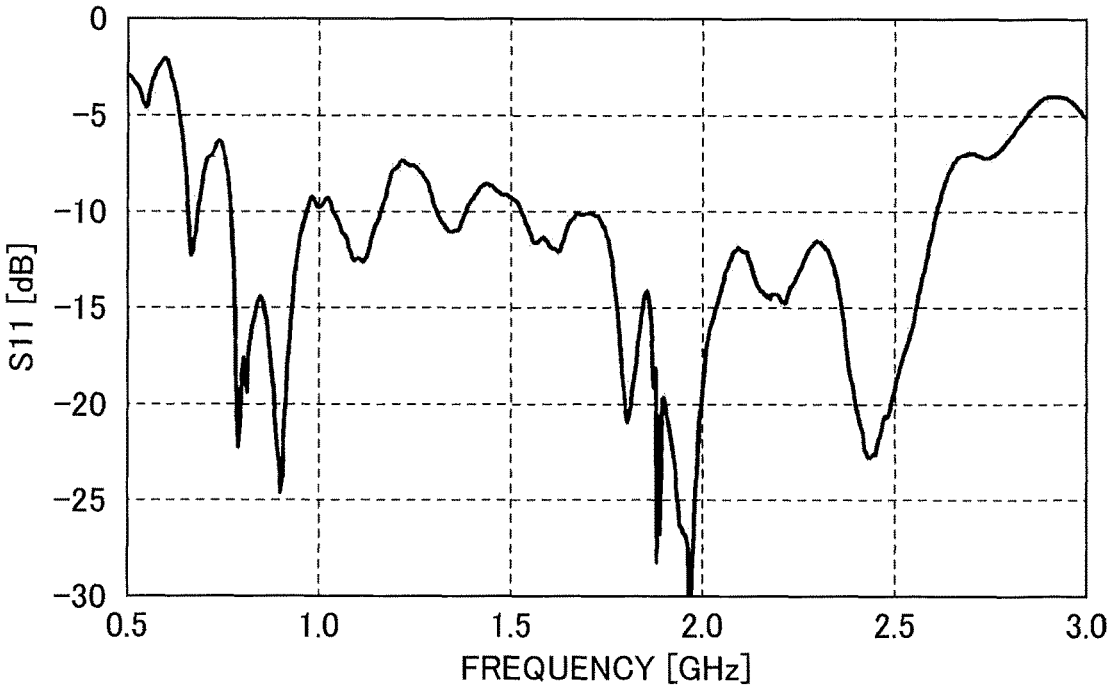
FIG. 20 is a graph illustrating a return loss in a case where the corner portion of the antenna according to the second embodiment is recessed.

FIG. 19 is a graph illustrating a return loss in a case where the corner portion 129 of the antenna 2 according to the second embodiment was not recessed. FIG. 20 is a graph illustrating a return loss in a case where the corner portion 129 of the antenna 2 according to the second embodiment was recessed. An obtained result was that the return loss characteristics of the antenna 2 in the band of 2.4 GHz to 2.48 GHz of the ISM bands improved when the recessed corner portion 129 was provided as compared with when the recessed corner portion 129 was not provided.

Figure 21:
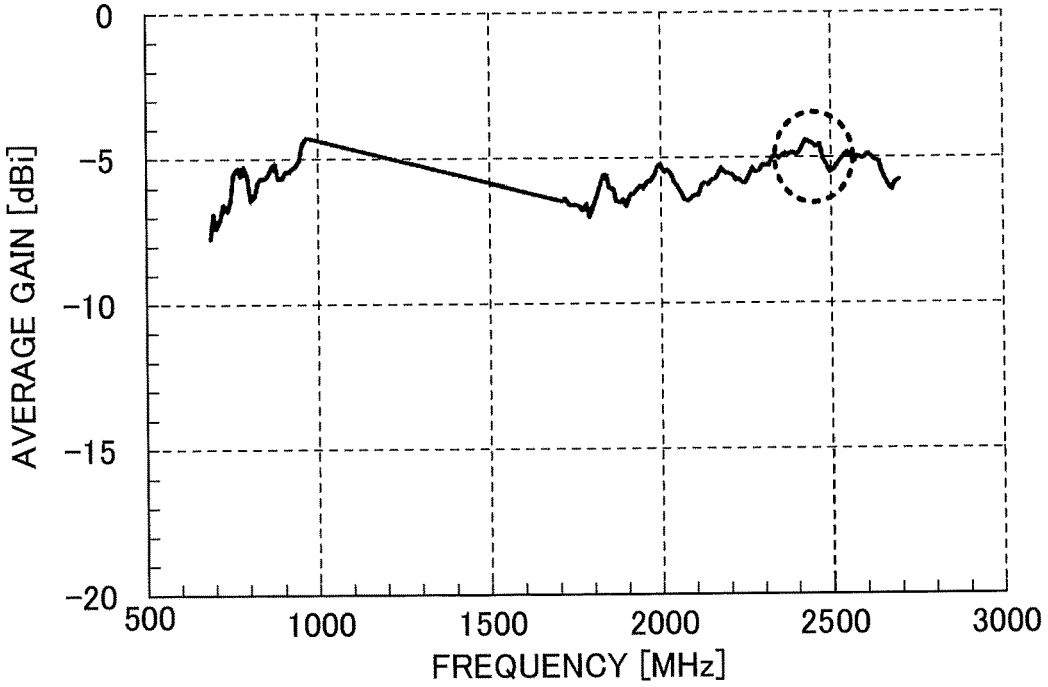
FIG. 21 is a graph illustrating frequency characteristics of an antenna gain in a case where the corner portion of the antenna according to the second embodiment is not recessed.
Figure 22:
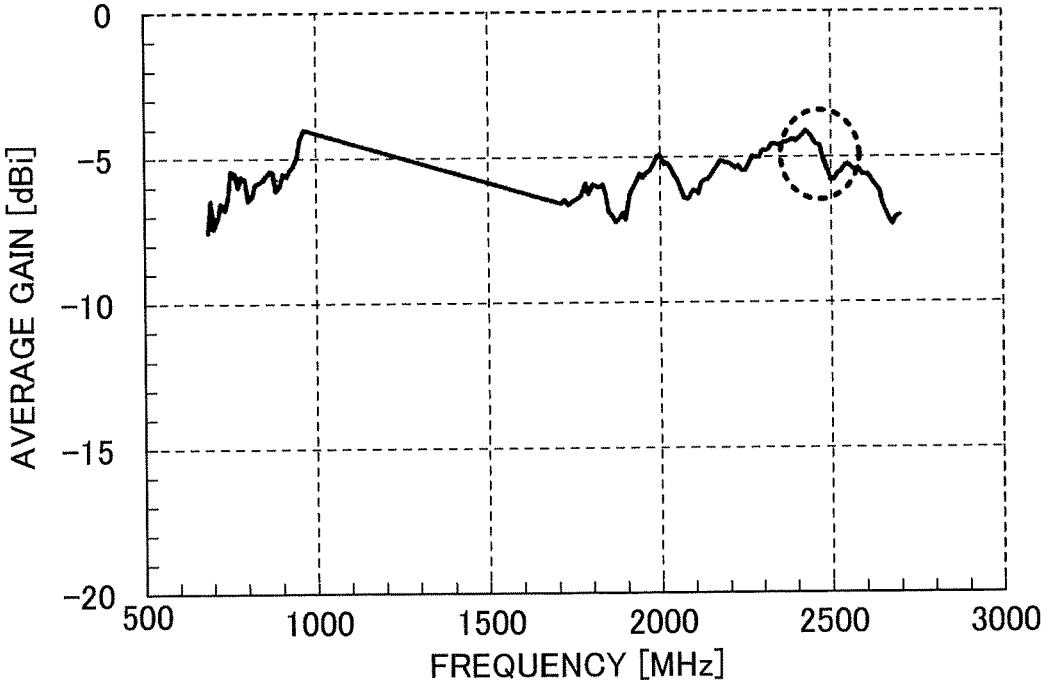
FIG. 22 is a graph illustrating frequency characteristics of an antenna gain in a case where the corner portion of the antenna according to the second embodiment is recessed.

FIG. 21 is a graph illustrating frequency characteristics of an antenna gain in a case where the corner portion 129 of the antenna 2 according to the second embodiment was not recessed. FIG. 22 is a graph illustrating frequency characteristics of an antenna gain in a case where the corner portion 129 of the antenna 2 according to the second embodiment was recessed. The vertical axis represents an average antenna gain. When the corner portion 129 is not recessed, the average antenna gain of the antenna 2 in the band of 2.4 GHz to 2.48 GHz of the ISM bands was −4.7 dBi, and when the corner portion 129 was recessed, the average antenna gain was −4.4 dBi, which means that the antenna gain improved.

Sixth Example

The antenna gain and the return loss characteristics depending on a difference in the size of the width W2 of the inner area 22*b* of the ground-side conductor 22 (see FIG. 3) of the antenna 1 according to the first embodiment were measured. The inner area 22*b* represents a conductor area of the ground-side conductor 22 between the left-side outer edge 93 and the virtual extension line extending in the Y axis direction through the open end 15*a* of the left wide slot 15.

Figure 23:
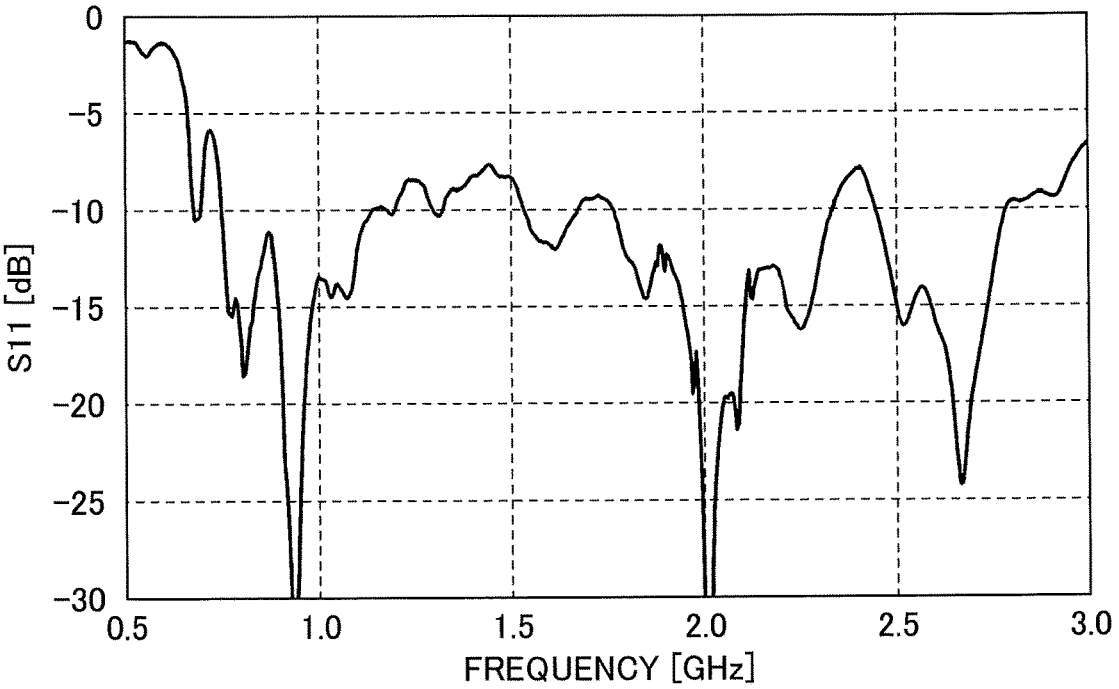
FIG. 23 is a graph illustrating a return loss in a case where a width of an inner area of a ground-side conductor of the antenna according to the first embodiment is short.
Figure 24:
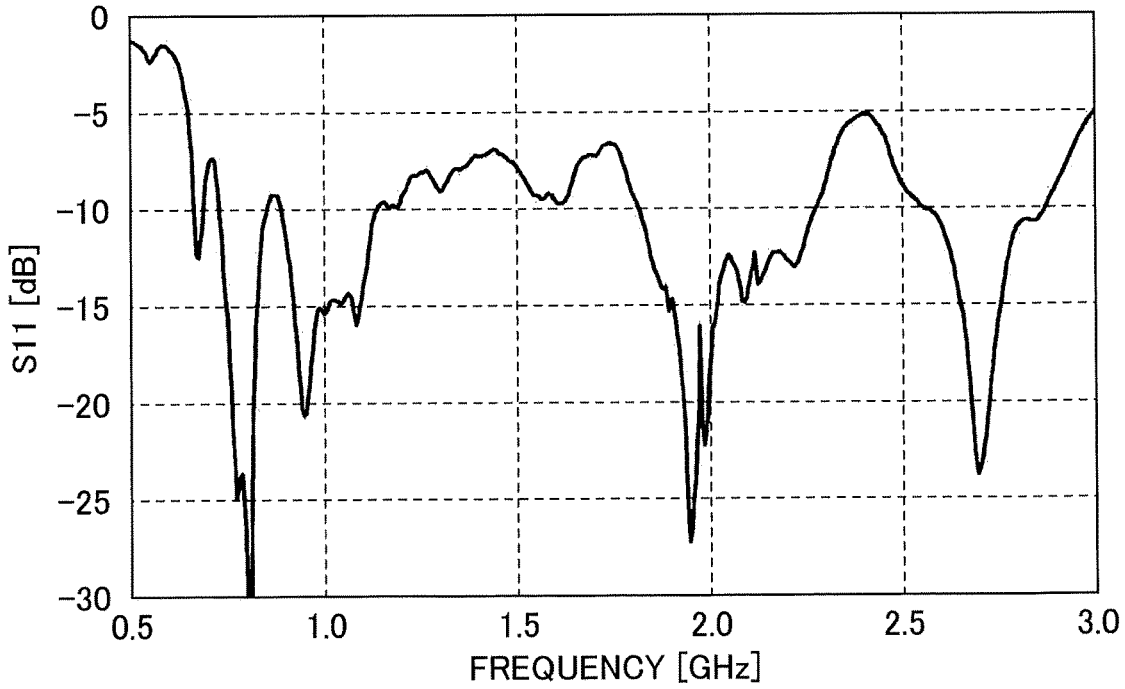
FIG. 24 is a graph illustrating a return loss in a case where a width of an inner area of a ground-side conductor of the antenna according to the first embodiment is long.

FIG. 23 is a graph illustrating a return loss in a case where the width W2 of the inner area 22*b* of the ground-side conductor 22 of the antenna 1 according to the first embodiment was short. FIG. 24 is a graph illustrating a return loss in a case where the width W2 of the inner area 22*b* of the ground-side conductor 22 of the antenna 1 according to the first embodiment was long. FIG. 23 illustrates a case where the number of rows of opened holes in the hole-formed portion 23 in the inner area 22*b* was four. FIG. 24 illustrates a case where the number of rows of opened holes in the hole-formed portion 23 in the inner area 22*b* was five as illustrated in FIG. 3. An obtained result was that the return loss characteristics of the antenna 1 in the low band improved when the width W2 of the inner area 22*b* was long as compared with when the width W2 was short.

Figure 25:
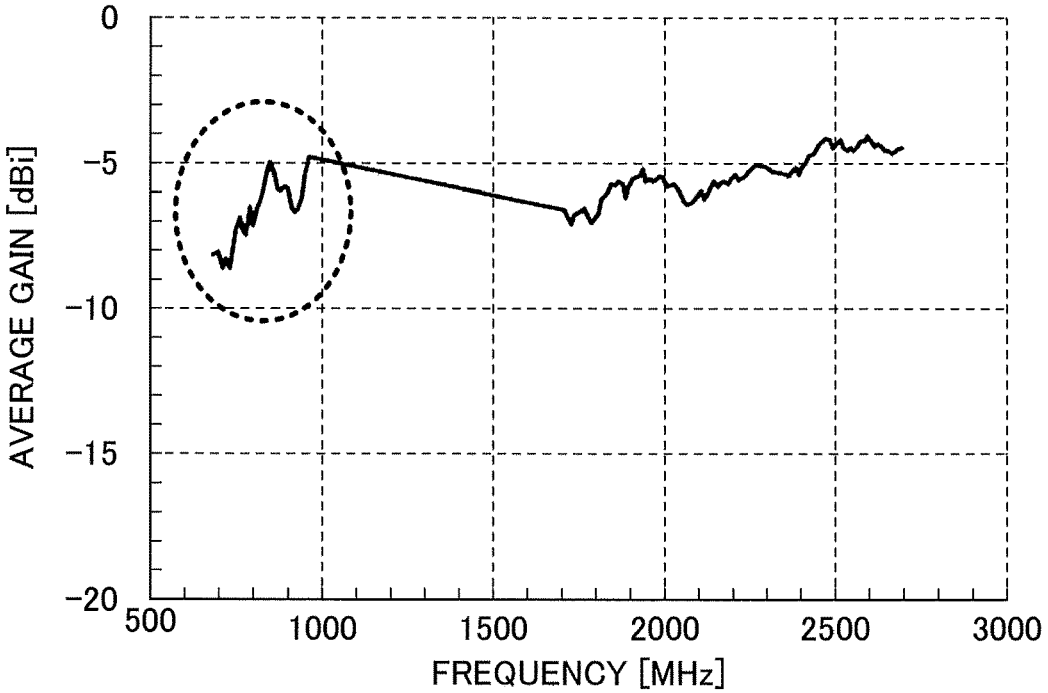
FIG. 25 is a graph illustrating frequency characteristics of an antenna gain in a case where a width of an inner area of a ground-side conductor of the antenna according to the first embodiment is short.
Figure 26:
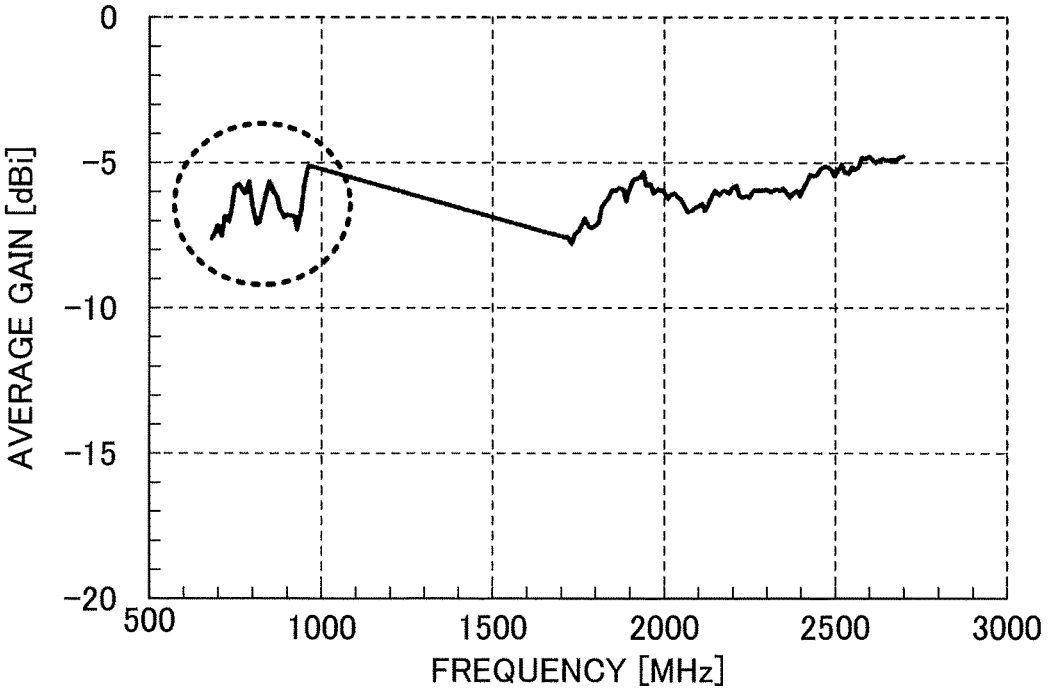
FIG. 26 is a graph illustrating frequency characteristics of an antenna gain in a case where a width of an inner area of a ground-side conductor of the antenna according to the first embodiment is long.

FIG. 25 is a graph illustrating frequency characteristics of an antenna gain in a case where the width W2 of the inner area 22*b* of the ground-side conductor 22 of the antenna 1 according to the first embodiment was short. FIG. 26 is a graph illustrating frequency characteristics of an antenna gain in a case where the width W2 of the inner area 22*b* of the ground-side conductor 22 of the antenna 1 according to the first embodiment was long. The vertical axis represents an average antenna gain. As illustrated in the figures, an obtained result was that the frequency characteristics of the average antenna gain of the antenna 1 in the low band was flattened when the width W2 was long as compared with when the width W2 was short.

As described above, the antenna and the window for the vehicle have been described with reference to the embodiments, but the present invention is not limited to the above-described embodiments. Various modifications and improvements are possible within the scope of the present invention, such as a combination or replacement with some or all of the other embodiments.

For example, an "end" of a slot may be a start or end point of an extension of the slot, or may be a point in proximity to the start or end point. Also, a connection portion between the slots may be connected with a curvature.

An "end" of a conductor (for example, an antenna element, a heating wire, a bus bar, or the like) may be a start or end point of an extension of the conductor, or may be a point in proximity to the start or end point which is a part of the conductor before the start or end point. Also, a connection portion between the conductors may be connected with a curvature.

The bus bar, the heating wires, the antenna element, and the feeding portion are formed by printing and sintering paste (for example, silver paste, and the like) containing, for example, a conductive metal on the surface of a vehicle-inner side of window glass. However, the method for forming the bus bar, the heating wire, the antenna element, and the feeding portion are not limited thereto. For example, the bus bar, the heating wires, the antenna element, or the feeding portion may be formed by providing a wire or foil containing a conductive substance such as copper on a vehicle-inner side surface or a vehicle-outer side surface of window glass. Alternatively, the bus bar, the heating wires, the antenna element, or the feeding portion may be pasted to window glass with an adhesive and the like, or may be provided in the inside of the window glass.

The shape of the feeding portion may be determined according to the shape of the surface on which the conductive member or the connector is mounted. For example, rectangular or polygonal shapes such as a square, an approximate square, a rectangle, or an approximate rectangle are preferable in terms of mounting. Circular shapes such as a circle, an approximate circle, an ellipse, or an approximate ellipse may be adopted.

In addition, it may be possible to employ a structure in which a conductive layer that forms at least one of a bus bar, a heating wires, and antenna element, and a feeding portion is provided inside or on a surface of a synthetic resin film, and the synthetic resin film with the conductive layer is pasted to a vehicle-inner side face or a vehicle-outer side face of a window glass. Furthermore, it may be possible to employ a structure in which a flexible circuit board formed with antenna elements is provided on a vehicle-inner side surface or a vehicle-outer side surface of a window glass.

For example, in FIG. 1, the arrangement positions of the right rear antenna 1 and the left rear antenna 2 may be exchanged with each other. The right rear antenna 1 and the left rear antenna 2 may be arranged in an upper area of the glass plate 60. For example, the right rear antenna 1 may be arranged in a right upper area, and the left rear antenna 2 may be arranged in a left upper area. In a case where the right rear antenna 1 and the left rear antenna 2 are arranged in an upper area of the glass plate 60, the right rear antenna 1 and the left rear antenna 2 are arranged upside-down.

Since a vehicle is a mobile object, a diversity antenna may be formed by a plurality of antennas. A multiple-input and multiple-output (MIMO) antenna, which is a function of increasing communication capacity with a plurality of antennas, may be famed.

What is claimed is:

1. An antenna including a flat conductor, the flat conductor comprising:

a first feeding point and a second feeding point located away from each other;

a first slot extending in a first direction between the first feeding point and the second feeding point;

a second slot including one end connected to one end of the first slot, the second slot extending in a second direction different from the first direction;

a third slot including one end connected to another end of the first slot and another end that is open through an outer edge of the conductor, the second slot and the third slot being disposed at opposite sides of a first virtual extension line, extending in a direction in which the first slot extends, from each other; and a fourth slot including one end connected to another end of the second slot, the fourth slot extending to one side of the second slot opposite from the first slot, wherein the third slot has a portion of which slot width is wider than the first slot, the fourth slot has a portion of which slot width is wider than the second slot, and the outer edge includes an inclined portion inclined with respect to a virtual line that passes through the another end of the third slot and that is perpendicular to a direction in which the third slot extends.

2. The antenna according to claim 1, wherein the inclined portion extends to one side of the virtual line opposite from the third slot.

3. The antenna according to claim 1, wherein the inclined portion extends at a same side of a third virtual extension line, extending in a direction in which the third slot extends, as the first slot.

4. The antenna according to claim 1, wherein the inclined portion extends from the another end of the third slot.

5. The antenna according to claim 1, wherein the conductor includes a recessed portion partially expanding a slot width of the first slot.

6. The antenna according to claim 1, wherein the conductor includes another outer edge extending at one side of a third virtual extension line, extending in a direction in which the third slot extends, opposite from the first slot, the another outer edge includes a second inclined portion inclined with respect to the third virtual extension line extending in the direction in which the third slot extends, and a distance between the second inclined portion and the third slot at the another end of the third slot is longer than a distance between the second inclined portion and the third slot at the one end of the third slot.

7. The antenna according to claim 1, wherein the conductor includes a third outer edge extending at one side of a second virtual extension line, extending in a direction in which the second slot extends, opposite from the first slot, the third outer edge includes a third inclined portion inclined with respect to the third virtual extension line extending in the direction in which the third slot extends, and a distance between the third inclined portion and the third slot at the another end of the third slot is shorter than a distance between the third inclined portion and the third slot at the one end of the third slot.

8. The antenna according to claim 1, wherein the conductor includes a step portion that includes a plurality of slot edges in parallel with the second direction to change a slot width of the fourth slot in a stepwise manner with the plurality of slot edges.

9. The antenna according to claim 1, wherein the conductor includes a protruding portion that partially reduces the slot width of the fourth slot.

10. The antenna according to claim 1, wherein the conductor includes a pair of outer edges forming a corner portion of the conductor, one outer edge of the pair of outer edges includes an open end of the fourth slot, another outer edge of the pair of outer edges extends at one side of the fourth slot opposite from the second slot, and the corner portion is recessed toward an inside of the conductor.

11. A window glass for a vehicle, comprising:

the antenna according to claim 1; and a glass plate provided with the antenna.

12. The window glass for the vehicle according to claim 11, wherein the glass plate includes a light shielding film overlapping the antenna, and the conductor includes an outer edge along an edge of the light shielding film.

* * * * *